US006488573B1

(12) United States Patent
Kobayashi et al.

(10) Patent No.: US 6,488,573 B1
(45) Date of Patent: Dec. 3, 2002

(54) POLISHING APPARATUS, POLISHING METHOD AND METHOD OF CONDITIONING POLISHING PAD

(75) Inventors: Tatsunori Kobayashi, Omiya (JP); Hiroshi Tanaka, Omiya (JP); Yasuyuki Ogata, Omiya (JP); Kanji Hosoki, Omiya (JP); Eturo Morita, Omiya (JP); Seiji Harada, Omiya (JP)

(73) Assignee: Mitsubishi Materials Corporation, Tokyo (JP)

( * ) Notice: Subject to any disclaimer, the term of this patent is extended or adjusted under 35 U.S.C. 154(b) by 0 days.

(21) Appl. No.: 09/651,299

(22) Filed: Aug. 30, 2000

(30) Foreign Application Priority Data

| | | |
|---|---|---|
| Aug. 30, 1999 | (JP) | 11-244120 |
| Jan. 12, 2000 | (JP) | 2000-004058 |
| Mar. 10, 2000 | (JP) | 2000-067799 |
| Mar. 30, 2000 | (JP) | 2000-093834 |
| Mar. 31, 2000 | (JP) | 2000-099648 |

(51) Int. Cl.[7] ..... B24B 29/00
(52) U.S. Cl. ..... 451/285; 451/443; 451/444
(58) Field of Search ..... 451/56, 443, 285, 451/286, 287, 288, 289, 444

(56) References Cited

U.S. PATENT DOCUMENTS

| | | | | |
|---|---|---|---|---|
| 5,885,138 A | * | 3/1999 | Okumura et al. | 451/67 |
| 5,908,347 A | * | 6/1999 | Nakajima et al. | 451/5 |
| 6,257,966 B1 | * | 7/2001 | Ishikawa et al. | 451/67 |
| 6,293,855 B1 | * | 9/2001 | Yoshida et al. | 451/67 |
| 6,358,131 B1 | * | 3/2002 | Sakurai et al. | 451/287 |

* cited by examiner

*Primary Examiner*—Timothy V. Eley
*Assistant Examiner*—Dung Van Nguyen

(74) *Attorney, Agent, or Firm*—Oblon, Spivak, McClelland, Maier & Neustadt, P.C.

(57) ABSTRACT

A polishing apparatus has a plurality of polishing stations for polishing materials to be polished and a plurality of cleaning stations for cleaning the materials being polished, the polishing stations and the cleaning stations being alternately arranged; and an arm for holding the materials being polished and transferring the materials being polished between the polishing stations and the cleaning stations successively. The arm includes a polishing head for holding the material being polished. Each of the cleaning stations comprises a retainer stand on which the material being polished is placed, and a cleaning device for cleaning the material being polished in a state held by the polishing head, cleaning the material being polished in a state placed on the retainer stand, and cleaning the polishing head in a state where the material being polished is separated from the polishing head. A polishing method is used in a polishing apparatus having a plurality of polishing stations for polishing materials to be polished and an arm for holding the materials being polished and transferring the materials being polished between the polishing stations successively, each of the polishing stations including a platen having a polishing pad affixed to a surface of the platen, the arm including a plurality of polishing heads, each of which holds the material being polished and brings one surface of the material being polished into contact with the polishing pad, the material to be polished being polished by the polishing pad with relative movement between the polishing head and the platen. The polishing method comprises the steps of fitting a spindle for supporting the polishing head in a horizontally rotatable manner into each of fitting portions formed in each of a plurality of spindle housings provided in the arm; rotating the material being polished and the polishing pad relatively while keeping the material being polished and the polishing pad contacted with each other; and adjusting an axial position of the polishing head and changing a position of the polishing head relative to the arm by an adjusting mechanism provided on the spindle, whereby the materials to be polished are each polished while being adjusted in position thereof

22 Claims, 22 Drawing Sheets

POLISHING APPARATUS, POLISHING METHOD AND METHOD OF CONDITIONING POLISHING PAD

BACKGROUND OF THE INVENTION

1. Field of the Invention

The present invention relates to an apparatus and a method for polishing a material such as a semiconductor wafer, and a method of conditioning a surface state of a polishing pad used for polishing the material to be polished.

This specification is on the basis of Japanese Patent Applications (Japanese Unexamined Patent Application Publication No. 11-244120, No. 2000-004058, No. 2000-093834, and No. 2000-099648), and the disclosures of these Japanese Patent Applications are incorporated herein as a part of this specification by reference.

2. Description of the Related Art

A semiconductor wafer cut out of a silicon ingot, for example, from which a semiconductor device is formed, must be polished for realizing fine device structures, in such a manner that the wafer surface acquires a mirror surface free from defects and having high accuracy. A chemical mechanical polishing process (CMP process) capable of providing a high degree of planarity has been employed to polish surfaces of materials for which high polishing accuracy is required, including semiconductor wafers and wafers having devices formed thereon (hereinafter referred to simply as wafers).

The CMP process chemically and mechanically polishes and flattens surfaces of materials to be polished by employing, for example, an alkaline slurry using $SiO_2$, a neutral slurry using $CeO_2$ or an acid slurry using $Al_2O_3$.

A known polishing apparatus 1 for polishing a wafer surface using a CMP process is schematically shown in FIG. 23 which is an enlarged perspective view of principal part of the apparatus. As shown, a polishing pad 4 made of hard urethane, for example, is affixed to a disk-shaped platen 3 attached to a central shaft 2, and a polishing head 5 holding a wafer W is from the central shaft 2 of the platen 3. The polishing apparatus 1 polishes one surface of the wafer W by moving the polishing pad 4 and the wafer W relative to each other, while the polishing head 5 holds the wafer W in contact with the surface of the polishing pad 4, and a slurry S is supplied between the wafer W and the polishing pad 4.

Another known example of a apparatus for polishing a wafer surface with the CMP process is shown in FIG. 24. In the following description, components in FIG. 24 having essentially the same construction as those of the polishing apparatus 1 shown in FIG. 23 are denoted by the same reference numerals. Referring to FIG. 24, a polishing apparatus 10 comprises a polishing head 5 holding a wafer W to be polished, and a polishing pad 4 affixed to an upper surface of a disk-shaped platen 3. A plurality of polishing heads 5 are attached to the underside of a carousel 11 serving as a head driving mechanism. The polishing heads 5 are each supported by a spindle 16 to rotate on the polishing pad 4 in planetary motion. In this connection, the center of the platen 3 may be positioned offset from the center about which the polishing heads 5 revolve.

The platen 3 is horizontally disposed at the center of a base 12 and rotated about its own axis by a platen driving mechanism (not shown) provided within the base 12. Posts 13 are vertically provided on both side portions of the base 12, and an upper attachment plate 14 is disposed between the posts 13 to support a carousel driving mechanism 15. The carousel driving mechanism 15 has the function of rotating the carousel 11 provided below the carousel driving mechanism 15 about its own axis.

Abutment portions 17 are disposed on the base 12 to project upward therefrom, and a gap adjusting mechanism 18 is provided at a top of each of the abutment portions 17. Above the abutment portions 17, engaging portions 19 are provided in one-to-one opposite relation. The engaging portions 19 are fixed to the upper attachment plate 14 and project downward from the upper attachment plate 14. By regulating the gap adjusting mechanisms 18 and bringing the engaging portions 19 into contact with the abutment portions 17, the distance between the polishing head 5 and the polishing pad 4 is set to an appropriate value. The wafers W are then polished by rotating the carousel 11, the polishing heads 5 and the platen 3 while the wafers W held by the polishing heads 5 are kept in contact with the surface of the polishing pad 4.

In any of such polishing apparatuses employing the CMP process, properties of the polishing pad and the slurry, polishing time, etc. are changed depending on the wafer polishing conditions, to adjust those parameters so that wafers are polished under the optimum conditions. Here, the term "properties of the slurry" means the material characteristics and size of abrasives forming the slurry, properties of a solution (such as pH and concentration of the solution) in which the abrasives are suspended, etc.

Furthermore, in the polishing apparatuses described above, a step of polishing a wafer surface is divided into several stages, for example a rough polishing stage for eliminating roughness on the wafer surface, a fine polishing stage for flattening the wafer surface, and a finish polishing stage for finishing the wafer surface to a mirror surface. In each stage, the wafer is polished under the respective optimum conditions.

In addition, thin films such as an oxide film and a metal film are formed on a wafer surface to form a circuit on the wafer. Therefore, the polishing conditions are also changed depending on material characteristics of the thin films formed on the wafer surface.

To enable a wafer to be polished successively under plural sets of different polishing conditions, there is known a polishing apparatus comprising a plurality of polishing stations, each of which includes a platen provided with a polishing pad and a driving device for driving the platen for rotation.

In such a polishing apparatus designed to move a wafer between the polishing stations operated under the different polishing conditions, if the slurry adhering to the wafer and the polishing head is not completely removed, the polishing station to which the wafer is transferred from a preceding one is contaminated with the slurry adhering to the wafer and the polishing head, because the properties of the slurry, i.e., the material characteristics and size of abrasives, properties of a solution, etc., differ between the polishing stations. Such mixing of slurries having different properties not only changes the polishing conditions in the polishing station of subsequent stage, but also may bring the slurry into a cohered or gelled state, thereby damaging the wafer surface, or may cause abnormal corrosion of the wafer.

For preventing such drawbacks, a cleaning device has been hitherto provided between the polishing stations to clean the wafer and the polishing head when the wafer and the polishing head are moved from one polishing station to another. However, the cleaning is usually carried out with the wafer kept supported by the polishing head, and the slurry having intruded into, e.g., between the wafer and the polishing head, cannot be completely removed. The remaining slurry is therefore caused to flow out and mix with a new slurry while the wafer is polished in the subsequent polishing station. As a result, the above-described drawbacks cannot be avoided using the present methods.

Further, in any of the polishing apparatuses described above, a number of fine holes, grooves or the like are formed in the polishing pad 4 to hold a slurry, and a wafer is polished with the slurry held on the surface of the polishing pad 4 with the aid of those holes, grooves or the like. However, repeating the wafer polishing gives rise to a problem of reducing the polishing accuracy and the polishing efficiency of wafers, because the slurry and other foreign matter (such as chips or debris particles of the polishing pad 4 and the wafer) adhere to the surface of the polishing pad 4, and the polishing pad 4 is loaded with them. Also, there is a risk that properties of the foreign matter may be changed with the lapse of time and may cause scratches in the wafer.

In view of the above problems, a conditioner 21 (loading eliminating device) shown in FIG. 23, for example, has been hitherto provided in the polishing apparatus to separate the foreign matter deposited on the polishing pad 4 from it and to prevent the polishing pad 4 from being loaded with the foreign matter (this operation is called conditioning). Additionally, though not shown, the conditioner 21 is also provided in the polishing apparatus 10 shown in FIG. 24.

As seen from FIG. 23, which is an enlarged perspective view of a principal part of the polishing apparatus, the conditioner 21 comprises a disk-shaped dresser 22 having a dressing portion (not shown in FIG. 23) formed on one surface, a rotating/driving mechanism (not shown) for rotating the dresser 22 about its own axis, and an arm 23 for holding the dresser 22. The conditioner 21 further comprises a moving mechanism 24 for moving the dresser 22, which has been carried onto the polishing pad 4, parallel to the polishing pad 4 while keeping the dresser 22 in a state where a surface of the dressing portion of the dresser 22 is contacted with the polishing pad 4 and the dresser 22 is pressed against the polishing pad 4. Instead of being positively rotated with the rotating/driving mechanism as described above, the dresser 22 may be constructed so as to rotate by frictional forces developed between the dresser 22 and the rotating polishing pad 4 during the conditioning.

The moving mechanism 24 comprises, for example, an X-axis rotating/driving mechanism 25 for rotating the arm 23 about an X axis (substantially perpendicular to the surface of the polishing pad 4), and a Y-axis rotating/driving mechanism 26 for rotating the arm 23 about a Y axis (substantially parallel to the surface of the polishing pad 4). Also, the moving mechanism 24 further comprises, though not shown, a mechanism for adjusting an inclination angle of the dresser 22 relative to the arm 23 so that the dresser 22 is held parallel to the polishing pad 4 when the dressing portion surface of the dresser 22 is brought into pressure contact with the polishing pad 4.

During the conditioning of the polishing pad 4, the conditioner 21 shown in FIG. 23, by way of example, operates as follows. First, the dressing portion surface of the dresser 22 is brought into pressure contact with the polishing pad 4 by the moving mechanism 24. Then the dresser 22 is rotated about its own axis, and at the same time it is reciprocally swung on the rotating polishing pad 4 by the X-axis rotating/driving mechanism 25. In this way, the dressing portion of the dresser 22 slightly chips off the surface of the polishing pad 4 to separate foreign matter deposited on the surface of the polishing pad 4. The polishing pad 4 is thereby given a fresh surface free from loading and dulling to restore the polishing ability of the polishing pad 4 (to achieve the so-called dressing).

In addition to the above-described conditioner 21, there are also known other loading eliminating devices, for example one wherein a cleaning liquid is sprayed under high pressure toward the polishing pad 4 by a cleaning-liquid jetting means to wash foreign matter out of the surface of the polishing pad 4, and wherein the foreign matter is beaten and scrubbed out of the surface of the polishing pad 4 with a rotating brush.

Even after use of the loading eliminating device, if foreign matter still remains on the surface of the polishing pad 4, it may cause scratches, etc. in the wafer being polished by the polishing pad 4 or may vary the polishing rate. To avoid the above problem, in the conventional loading eliminating device, the slurry and other foreign matter (including abrasives scraped off the dresser 22), which have been separated from the polishing pad 4, are removed from the polishing pad 4, for example by supplying a cleaning liquid (including pure water), a slurry, etc. to the surface of the polishing pad 4 so as to wash out the remaining foreign matter. However, the amount of the supplied cleaning liquid or slurry is not large, and hence the removal efficiency of the foreign matter is low.

In a method of washing out the foreign matter with a slurry, the slurry supplied for the washing-out cannot be used to polish a wafer because of a fear that the foreign matter can remain mixed in the slurry. Also, even in a method of washing out the foreign matter with a cleaning liquid (e.g., pure water), a part of the cleaning liquid remains on the polishing pad 4, and therefore the concentration, pH, etc. of a slurry newly supplied to the surface of the polishing pad 4 for polishing the wafer are changed, whereby the wafer polishing conditions are also changed. Thus, the above-described conventional methods are disadvantageous because the slurry or cleaning liquid remaining on the polishing pad 4 must be replaced by the newly supplied slurry for polishing the wafer, and so the amount of the slurry used and the cost are increased.

Further, because the conventional loading eliminating device employs a rotating dresser or brush, a cleaning liquid sprayed under high pressure, or the like, there has been a risk that the foreign matter may scatter to the surroundings and remain on the polishing pad 4, or may adhere to the polishing apparatus 1 and then drop off onto the polishing pad 4 from the polishing apparatus 1, thereby contaminating the polishing pad 4. In addition, there has been a risk that the scattered foreign matter may intrude into moving parts of the polishing apparatus 1 and eventually impede the normal operation of the polishing apparatus 1.

Further, in the conditioner 21 shown in FIG. 23, by way of example, materials such as chips of the polishing pad 4, debris particles of the wafer and the slurry having the changed properties, for example, are deposited primarily on the dressing portion surface of the dresser. If those deposits are solidified or gelled to have their properties changed, the deposits having the changed properties are scaled off and drop onto the polishing pad 4 when the polishing pad 4 is subjected to conditioning. This has raised a problem that the dropped scales damage the wafer surface, to produce scratches, etc. during the subsequent wafer polishing. Also, even when the dressing portion surface of the dresser is immersed in a cleaning liquid, the deposits cannot be removed from the dressing portion surface because of sticky adhesion to it, and a problem similar to that described above has been caused.

In any of the above-described polishing apparatus, grooves are formed beforehand in the surface of the polishing pad 4 to introduce air between the wafer and the polishing pad 4, so that the wafer will not adhere to the surface of the polishing pad 4 and will not be left on the polishing pad 4 when the polishing head 5 is elevated after completion of the wafer polishing. The presence of such grooves prevents the wafer from adhering to the polishing pad 4 and ensures proper progress of the polishing step.

The grooves each have a depth of about 0.5 mm. In addition to the above effect, the grooves also hold the slurry which is used for the wafer polishing on the polishing pad 4, and receive the chips, debris particles, etc. generated during the wafer polishing, thereby preventing the occurrence of scratches in the wafer surface.

In this connection, the surface of the polishing pad 4 is usually conditioned for each cycle of polishing so that the polishing ability is adjusted to fall within the appropriate range, as described above. The conditioning of the polishing pad 4 is performed, for example, by chipping off the surface of the polishing pad 4 in a thickness of about 1–2 $\mu$m by the dresser 22 of the conditioner 21 and forming a fresh surface of appropriate roughness.

Because the surface of the polishing pad 4 is chipped off bit by bit whenever it is subjected to the conditioning, the depth of the grooves formed in the surface of the polishing pad 4 is gradually reduced. The shallower the grooves, the less effective is the polishing pad 4 in the step of polishing wafers. Therefore, at the time when the groove depth is reduced to a certain value, the polishing pad 4 is judged as having finished its useful life and is replaced by a new one. In other words, the polishing pad 4 is a consumable member and its useful life is determined depending on the remaining depth of the grooves. Since the cost of the polishing pad 4 takes a large proportion of the running cost of the polishing apparatus, there has been a desire for prolonging the useful life of the polishing pad 4 in order to reduce the production cost of wafers.

However, if the grooves are too deep, an amount by which the surface of the polishing pad 4 is projected from bottom surfaces of the grooves is so increased that the surface of the polishing pad 4 is more easily susceptible to elastic deformation. With such elastic deformation, the state of contact between the polishing pad 4 and the wafer is changed, which in turn changes the wafer polishing conditions. Thus, because of a restriction on the groove depth, the useful life of the polishing pad 4 cannot currently be prolonged as desired.

SUMMARY OF THE INVENTION

Accordingly, it is an object of the present invention to provide a polishing apparatus and a polishing method, which can polish a material to be polished under a plurality of polishing conditions in a satisfactory manner.

To achieve the above and other objects, the present invention provides a polishing apparatus comprising a plurality of polishing stations for polishing materials to be polished and a plurality of cleaning stations for cleaning the materials being polished. The polishing stations and the cleaning stations are alternately arranged, and an arm is provided for holding the materials to be polished and transferring the materials being polished between the polishing stations and the cleaning stations successively. The arm includes a polishing head for holding the material being polished, each of the cleaning stations comprising a retainer stand on which the material being polished is placed and a cleaning device for cleaning the material being polished while being held by the polishing head, cleaning the material being polished while placed on the retainer stand, and cleaning the polishing head where the material being polished is separated from the polishing head.

With the polishing apparatus thus constructed, when the material being polished is moved between the polishing stations, it is transferred to the cleaning station and cleaned therein before being moved to the next polishing station.

In the cleaning station, the cleaning device cleans the material being polished while held by the polishing head, cleans the material being polished while placed on the retainer stand, and cleans the polishing head where the material being polished is separated from the polishing head. Accordingly, a slurry having intruded into between the material being polished and the polishing head can also be removed. As a result, even in the case of polishing the material to be polished under plural sets of polishing conditions, the risk that slurries having different properties may mix with each other can be reduced, and the material to be polished can be satisfactorily performed under plural sets of polishing conditions.

Also, the present invention provides a polishing method for use in a polishing apparatus comprising a plurality of polishing stations for polishing materials to be polished and an arm for holding the materials being polished and transferring the materials being polished between the polishing stations successively, each of the polishing stations including a platen having a polishing pad affixed to a surface of the platen, the arm including a plurality of polishing heads, each of which holds the material being polished and brings one surface of the material being polished into contact with the polishing pad, the material to be polished being polished by the polishing pad with relative movement between the polishing head and the platen, the polishing method comprising the steps of fitting a spindle for supporting the polishing head in a horizontally rotatable manner into each of fitting portions formed in each of a plurality of spindle housings provided in the arm; rotating the material being polished and the polishing pad relatively while keeping the material being polished and the polishing pad contacted with each other; and adjusting an axial position of the polishing head and changing a position of the polishing head relative to the arm by an adjusting mechanism provided on the spindle, whereby the materials to be polished are each polished while being adjusted in position thereof.

With the polishing method of the present invention, the position of each polishing head is adjusted by the adjusting mechanism provided on the spindle, and the material to be polished is polished in the state where it has been thus adjusted in position. Therefore, the materials to be polished can each be polished under individual appropriate polishing conditions, and the polishing of the material to be polished can be performed with satisfactory results.

Another object of the present invention is to provide a method for conditioning a polishing pad, which can quickly and efficiently remove foreign matter from the polishing pad and can keep the foreign matter from scattering to the surroundings.

To achieve the above object, the present invention provides a method of conditioning a polishing pad for polishing a material to be polished, the method being used with a conditioner comprising a loading eliminating unit for separating foreign matter which is deposited on the polishing pad, from the polishing pad, a cover for covering surroundings of the loading eliminating unit to form a space isolated from the outside between the cover and a surface of the polishing pad, and a sucking unit connected to the space formed between the cover and the surface of the polishing pad for sucking the foreign matter on the polishing pad. The method comprises the steps of separating the foreign matter which is deposited on the polishing pad, from the polishing pad by the loading eliminating unit; sucking the foreign matter on the polishing pad by the sucking unit; and continuing operation of the sucking unit after the step of separating the foreign matter by the loading eliminating unit has been stopped, thereby sucking the foreign matter left on the polishing pad.

With the above method of conditioning the polishing pad, the foreign matter is separated from the polishing pad by the loading eliminating unit, and the separated foreign matter is sucked by the sucking unit and quickly removed from the polishing pad.

Also, since the loading eliminating unit eliminates the loading of the polishing pad in the space formed between the cover and the polishing pad, the separated foreign matter is not scattered to the surroundings.

Further, in parallel to the work of separating the foreign matter from the polishing pad by the loading eliminating unit, the foreign matter on the polishing pad is sucked by the sucking unit and quickly removed from the polishing pad.

Additionally, since the foreign matter left on the polishing pad is removed by the sucking unit even after stopping the operation of the loading eliminating unit, the foreign matter left on the polishing pad is minimized.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

First Embodiment

A polishing apparatus 31 according to a first embodiment of the present invention will be described below with reference to FIGS. 1 to 5. In this embodiment, the polishing apparatus 31 is employed particularly for polishing a surface of a semiconductor wafer in a process of forming circuit patterns for a semiconductor device by coating a metal film for wiring, e.g., a Cu film, and an insulating film, e.g., an $SiO_2$ film, one above the other alternately. In other words, the polishing apparatus 31 is adapted for polishing operations in which slurries having different properties are used for steps of forming the respective films (an alkaline slurry is used in polishing the Cu film and a neutral slurry is used in polishing the $SiO_2$ film).

Figure 1:
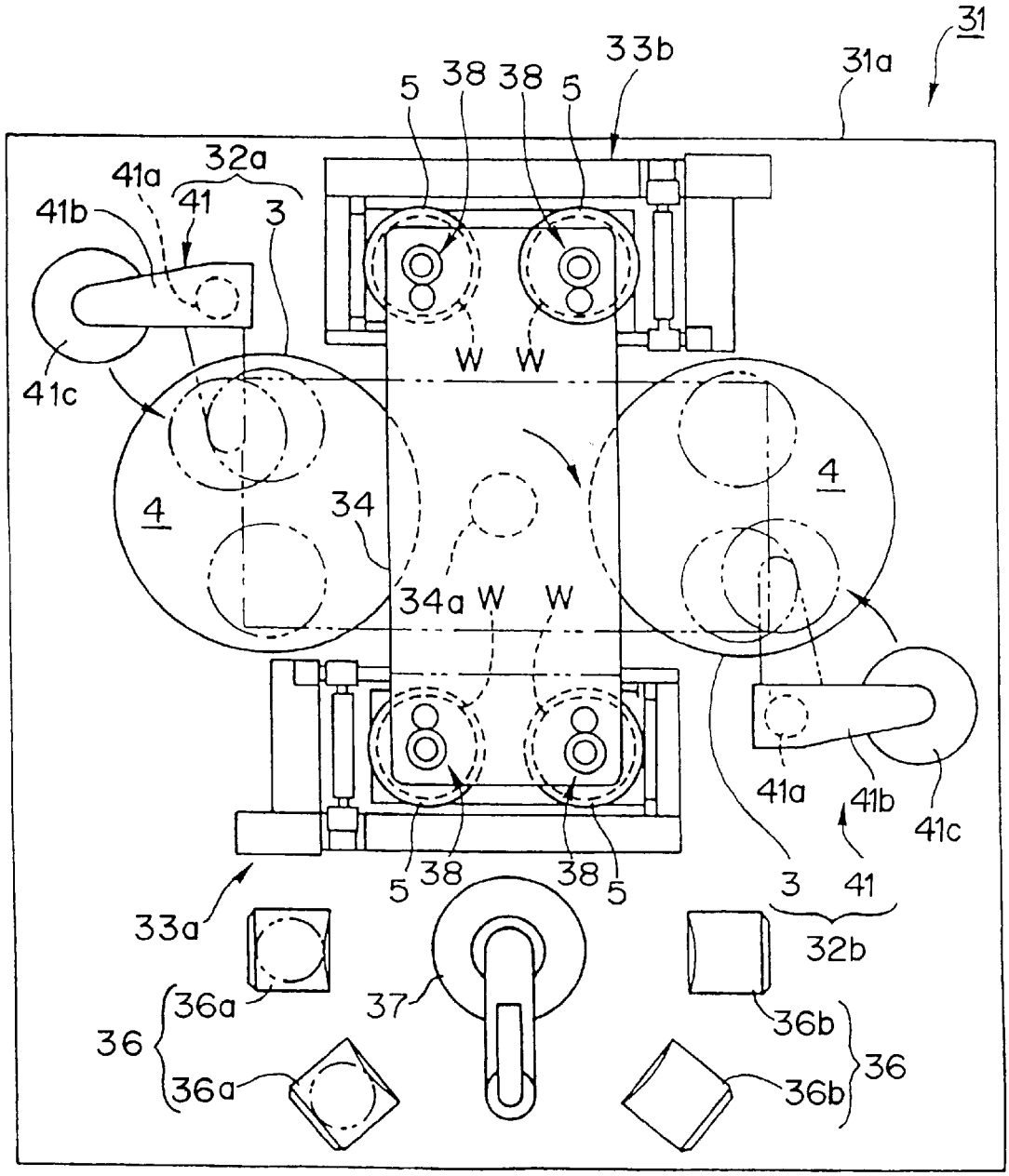
FIG. 1 is a plan view of a polishing apparatus according to a first embodiment of the present invention.

As shown in a plan view of FIG. 1, the polishing apparatus 31 comprises polishing stations 32*a,* 32*b* for polishing wafers W (materials to be polished), cleaning stations 33*a*, 33*b* for cleaning the wafers W, and an arm 34 for holding the wafers W and transferring them between the polishing stations and the cleaning stations successively, all of those stations and the arm being provided on a base 31*a* that is substantially rectangular when viewed from above. Further, the polishing apparatus 31 comprises, in the vicinity of the cleaning station 33*a,* cassettes 36 for accommodating the wafers W therein, and a robot arm 37 for transferring the wafers W between the cassettes 36 and the cleaning station 33*a.*

The arm 34 is formed of a substantially rectangular plate that is supported at its center by a rotating shaft 34*a* (rotating shaft) such that it can rotate about the arm rotating shaft 34*a* substantially on a horizontal plane located above the polishing stations 32*a,* 32*b* and the cleaning stations 33*a,* 33*b.* Also, two units of polishing heads 5 for holding the wafers W are provided on the underside of the arm 34 at each of opposite ends through respective spindles 38. The polishing stations 32*a,* 32*b* and the cleaning stations 33*a,* 33*b* are alternately arranged to lie substantially on a circle about the rotating shaft 34*a* of the arm 34. In this embodiment, these four stations are disposed at phase differences (angular intervals) of about 90 degrees with respect to the arm rotating shaft 34*a.*

The cassettes 36 comprise in-cassettes 36*a* for accommodating the wafers W that are not yet subjected to the polishing, and out-cassettes 36*b* for accommodating the wafers W that have been subjected to the polishing. These cassettes 36 are arranged to lie on a circle about the robot arm 37 (see FIG. 1).

Note that operations of the components of the polishing apparatus 31 are automatically or manually controlled by a control unit (not shown).

The polishing stations 32*a,* 32*b* each comprise, as shown in FIG. 1, a platen 3 having a polishing pad 4 which is made of hard urethane, for example, and affixed to an upper surface of the platen 3 for polishing the wafers W, and a conditioner 41 for dressing a surface of the polishing pad 4 to condition its surface. Each polishing station further comprises a slurry supply device (not shown) for supplying a slurry to the surface of the polishing pad 4.

Figure 23:
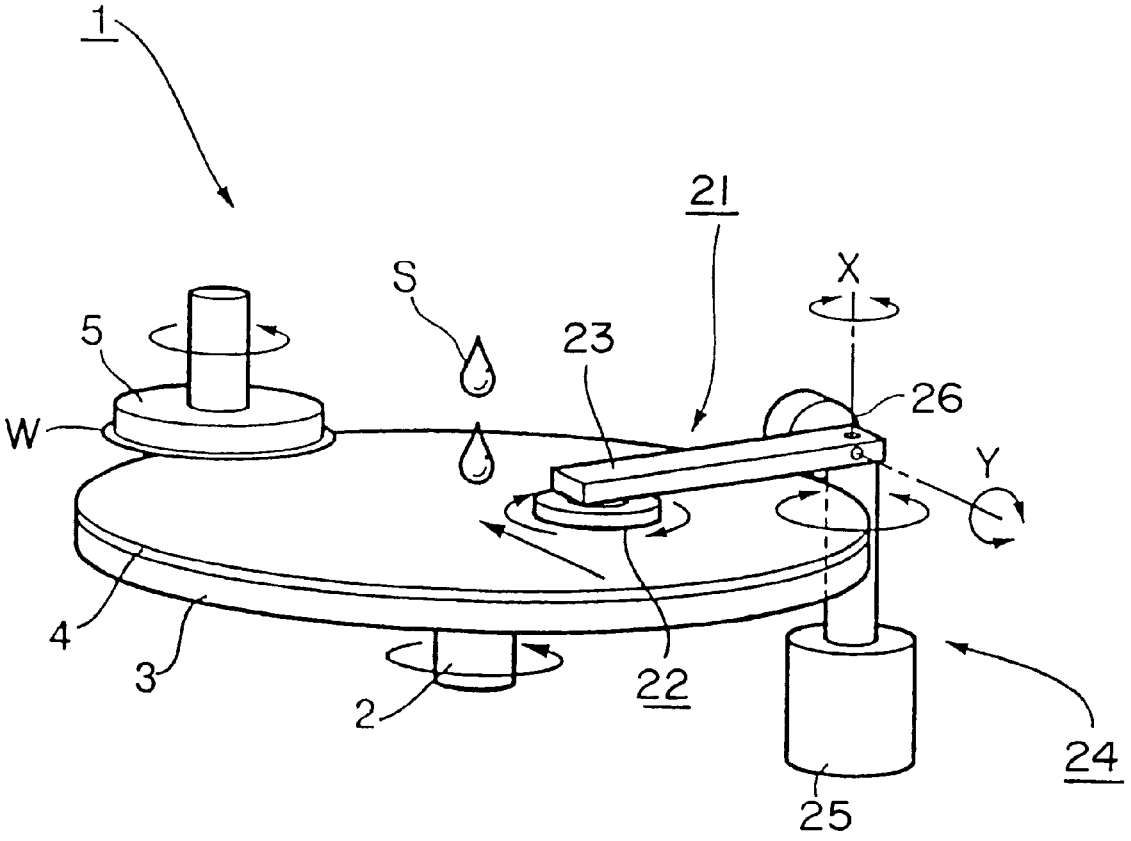
FIG. 23 is an enlarged perspective view of principal part of a conventional polishing apparatus and a conditioner used therein.
Figure 24:
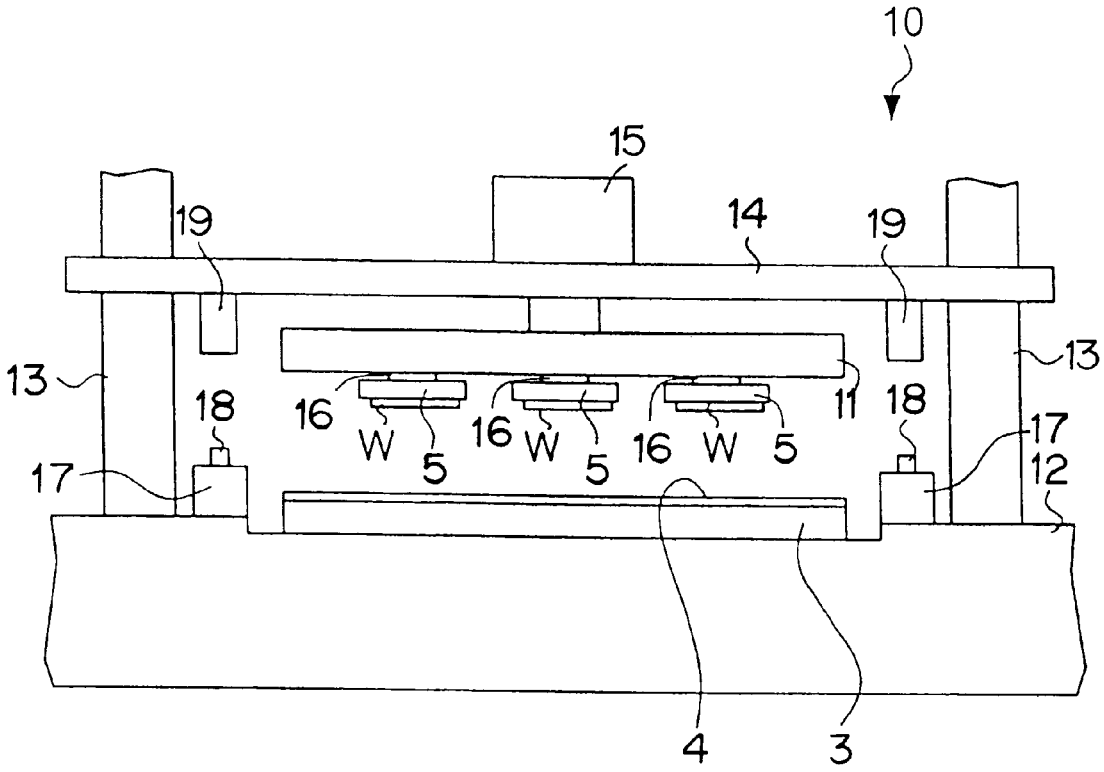
FIG. 24 is a front view showing a construction and structure of another conventional polishing apparatus.

The conditioner 41 has basically the same construction as the conditioner 21 shown in FIG. 23. More specifically, a dresser 41*c* is supported through a swing arm 41*b* by a conditioner rotating shaft 41*a* that is provided laterally of the platen 3. By turning the conditioner rotating shaft 41*a* with a moving mechanism 24 (not shown in FIG. 1), the dresser 41*c* is reciprocally swung on the rotating polishing pad 4, whereby the surface of the polishing pad 4 is dressed.

The platen 3 and the dresser 41*c* of the conditioner 41 are driven by respective driving devices (not shown) for rotation while they are held in contact with each other (instead of being positively rotated with the driving device, the dresser 41*c* may be constructed so as to rotate by frictional forces developed between the dresser 41*c* and the rotating polishing pad 4).

In this embodiment, the polishing station 32*a* is adjusted to carry out rough polishing of the wafers W, and the polishing station 32*b* is adjusted to carry out fine polishing of the wafers W. Stated otherwise, the polishing station 32*a* employs the polishing pad 4 and a slurry, both having a high polishing ability, and is set to have a sufficiently long polishing time because the wafers W are polished by a larger amount. The polishing station 32*b* employs the polishing pad 4 and a slurry, both having a low polishing ability, and is set to have a short polishing time because the wafers W are polished by a smaller amount.

Figure 2:
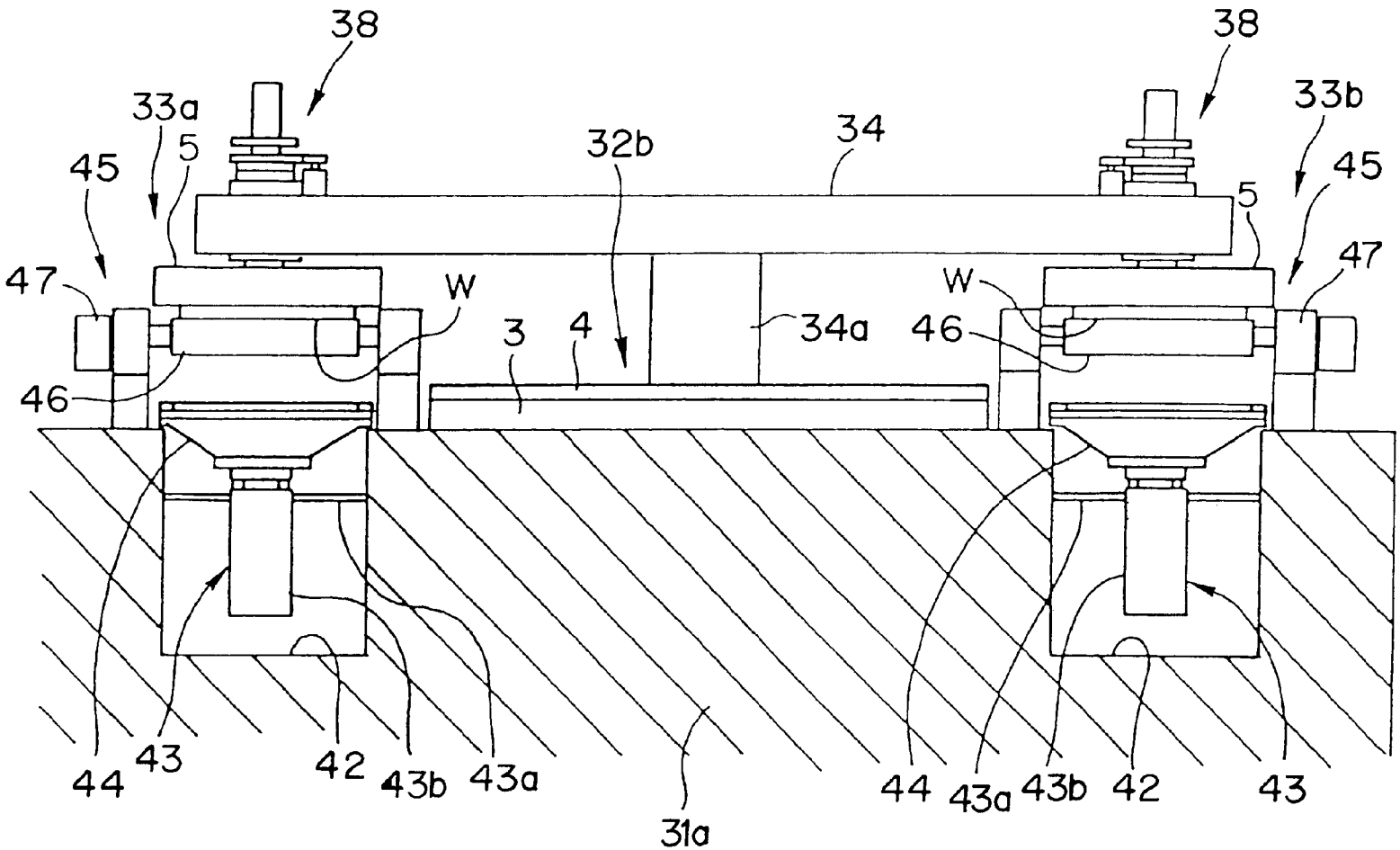
FIG. 2 is an enlarged side sectional view of principal part of the polishing apparatus according to the first embodiment of the present invention.

As shown in FIG. 2, which is an enlarged side sectional view of principal part of the polishing apparatus, the cleaning stations 33*a,* 33*b* each comprise an accommodating recess 42 formed in the base 31*a,* a substantially dish-shaped retainer stand 44 provided in the accommodating recess 42 in coupled relation to a lifting device 43 and holding the wafer placed on an upper surface thereof, and a cleaning device 45 for cleaning the wafer W and the underside of the polishing head 5.

Figure 3:
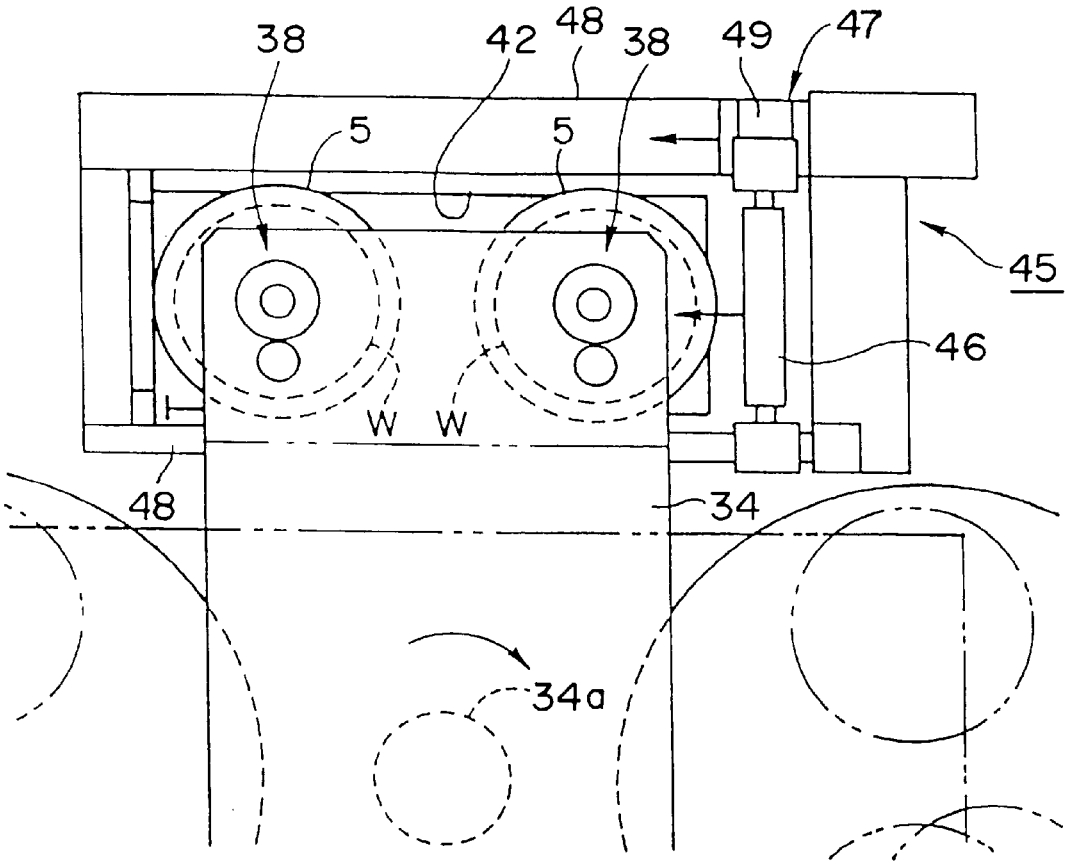
FIG. 3 is an enlarged plan view of principal part of the polishing apparatus according to the first embodiment of the present invention.

As shown in FIG. 3, which is an enlarged plan view of principal part of the polishing apparatus, the accommodating recess 42 is formed to extend along the tangential direction with respect to the center of rotation of the arm 34.

Two retainer stands 44 are arranged side by side in the longitudinal direction of the accommodating recess 42 in opposite relation to the two polishing heads 5 which are provided at each of both side ends of the arm 34. The retainer stand 44 is moved by the lifting device 43 in a direction toward the polishing head 5 on the arm 34 while being kept in opposite relation to the polishing head 5 (FIG. 2 shows only one unit of the two polishing heads 5 and the two retainer stands 44). In this embodiment, as shown in FIG. 2, the lifting device 43 is constructed as a pneumatic cylinder 43*b* that is mounted to an inner wall surface of the accommodating recess 42 through a stay 43*a* and is able to extend and contract toward and away from the polishing head 5.

As shown in FIGS. 2 and 3, the cleaning device 45 comprises a cleaning roller 46 (cleaning member) provided such that its rotating shaft extends almost horizontally and perpendicularly to the longitudinal direction of the accommodating recess 42, and a cleaning-member driving device 47 for advancing the cleaning roller 46 to a position between the polishing head 5 and the retainer stand 44.

The cleaning roller 46 is formed to have a length greater than the outer diameter of the wafer W, and includes a sponge member or the like provided over a circumferential surface of the cleaning roller 46. By rotating the cleaning roller 46 with the cleaning-member driving device 47, the slurry, etc. adhering to the wafer W and the underside of the polishing head 5 are scraped off and removed by the sponge member or the like. A cleaning liquid such as pure water is supplied from a cleaning liquid supply device (not shown) to the rotating shaft of the cleaning roller 46, and the supplied cleaning liquid is transferred to the outer periphery through the sponge member. As a result, the cleaning liquid rinses out the wafers W, the polishing heads 5 and the cleaning roller 46 itself, and the cleaning can be performed in a more effective manner.

The cleaning-member driving device 47 comprises a pair of rails 48 laid to extend in the longitudinal direction of the accommodating recess 42 along both edges thereof, and a drive motor 49 for driving the cleaning roller 46 to rotate about a rotary shaft, the drive motor 49 being movable on one of the rails 48 by an associated driving device (not shown).

The polishing head 5 is supported at its upper end by the arm 34 for up-and-down movement while it is allowed to rotate substantially in the horizontal direction, and holds at its bottom portion one surface of the wafer W (see FIG. 2). Also, the polishing head 5 is coupled to a driving device (not shown) and driven to rotate on a plane almost parallel to the surface of the polishing pad 4 in the polishing station 32*a* or the polishing station 32*b*.

Incidentally, FIG. 2 shows only the polishing station 32*b*, and the conditioner 41 is omitted in FIG. 2. The spindle 38 is provided in a coupling portion between the arm 34 and the polishing head 5 shown in FIG. 2.

Figure 4:
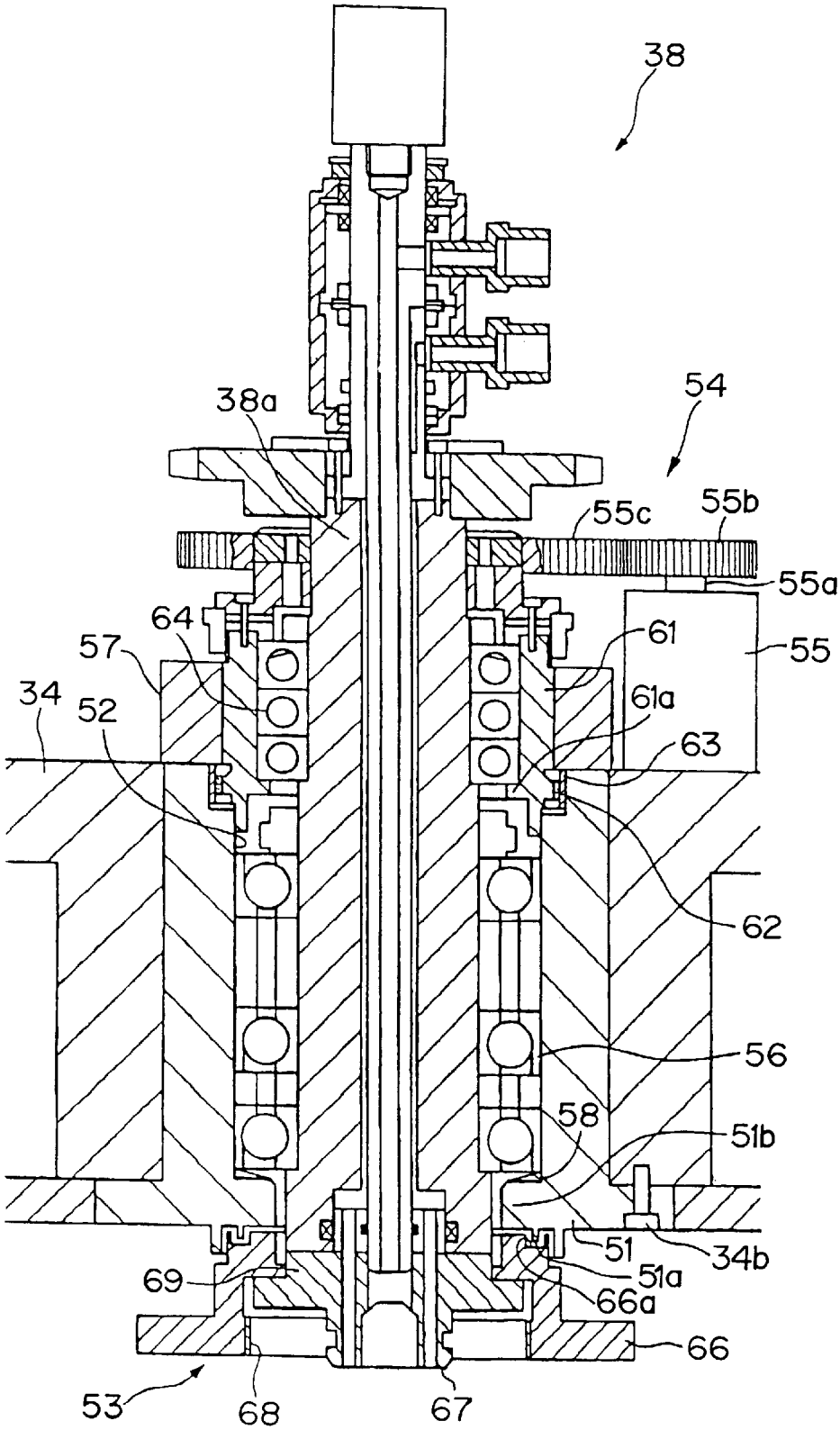
FIG. 4 is a side sectional view of a spindle used in the polishing apparatus according to the first embodiment of the present invention.

FIG. 4 is a side sectional view of the spindle 38. The spindle 38 is disposed to penetrate a fitting portion 52 in the form of a through hole in a spindle housing 51 provided in the arm 34. The spindle 38 comprises a spindle body 38*a* substantially in the form of a cylinder, a spindle-side coupling portion 53 located under the arm 34 and an adjusting mechanism 54 provided above the arm 34 for changing the relative positional relationship between the spindle body 38*a* and the arm 34. A first bearing 56 is provided in the fitting portion 52 and supports the spindle body 38*a* in a rotatable manner. Further, an upper flange 57 is provided on an upper surface of the arm 34. The spindle 38 and the arm 34 are coupled to each other by attachment screws 34*b*.

The first bearing 56 is fitted to the cylindrical fitting portion 52 formed in the spindle housing 51. On this occasion, the first bearing 56 is supported in the fitting portion 52 for axial sliding movement with the outer periphery of the first bearing 56 and an inner periphery of the fitting portion 52 not fixed, but free relative to each other. Also, the first bearing 56 and the spindle body 38*a* are arranged such that the relative positional relationship between them will not be changed in the axial direction.

Two annular projections 51*a*, each in the form of a circular ring, are projected downward vertically from the underside of the spindle housing 51 to provide a double wall. Further, an annular stopper 51*b* is formed to project radially from the inner periphery of the fitting portion 52 at its lowermost end, and serves to restrict downward movement of the first bearing 56 supported in a slidable manner. In addition, an annular leaf spring 58 may be disposed on an upper surface of the stopper 51*b*. The provision of the leaf spring 58 is effective in dampening a shock caused when a bottom surface of the first bearing 56 abuts against the stopper 51*b*.

A bearing support 61 is provided within the upper flange 57 having a cylindrical form. The bearing support 61 is also in the form of a cylinder, and a male threaded portion 62 for position adjustment is formed on an outer peripheral surface of the bearing support 61 in its lower portion. The male threaded portion 62 for position adjustment is meshed with a female threaded portion 63 for position adjustment formed on an inner peripheral surface of the spindle housing 51 in its upper portion. In such an arrangement, the position-adjustment female threaded portion 63 is formed to have a width in the axial direction greater than that of the position-adjustment male threaded portion 62. Also, the outer peripheral surface of the bearing support 61 is held in sliding contact with an inner peripheral surface of the upper flange 57 so that the bearing support 61 is rotatable within the upper flange 57.

A second bearing 64 is disposed in a cylindrical inner space of the bearing support 61, and the spindle body 38*a* is rotatably supported by the second bearing 64 and the first bearing 56. Further, a stepped portion 61*a* is formed at a lower end of the bearing support 61 to support the second bearing 64 from below, and an outer periphery of the second bearing 64 and an inner periphery of the bearing support 61 are fixed to each other. The second bearing 64 is constructed by an angular ball bearing and restricts movement of the spindle body 38*a* in the axial direction (thrust direction). Accordingly, the relative positional relationship between the spindle body 38*a* and the second bearing 64 is not changed.

A driven gear 54*c* is disposed above the bearing support 61 and has a cylindrical portion formed at its center for insertion of the spindle body 38*a* through the cylindrical portion. The spindle body 38*a* is rotatable in the cylindrical portion of the driven gear 54*c*. A drive motor 54 is installed on the arm 34 and has a drive gear 54*b* fitted over a drive shaft 54*a*. The drive gear 54*b* is meshed with the driven gear 54*c*.

Rotation of the drive shaft 54*a* of the drive motor 54 is transmitted to the driven gear 54*c* through the drive gear 54*b*, thereby rotating the driven gear 54*c* together with the bearing support 61. The bearing body 38*a* is therefore movable in the axial direction.

In other words, the bearing support 61, the driven gear 54*c* and the second bearing 64 are held in relatively fixed relation, and the first bearing 56 is slidable relative to the spindle housing 51. Also, movement of the spindle body 38*a* in the thrust direction is restricted by the second bearing 64, and the relative positional relationship between the first bearing 56, the second bearing 64 and the spindle body 38*a* is not changed.

In the above arrangement, by rotating the bearing support 61, the position-adjustment male threaded portion 62 is rotated while meshing with the position-adjustment female threaded portion 63, and correspondingly the bearing support 61 is moved in the axial direction relative to the spindle housing 51. Therefore, the spindle shaft 38*a* is also moved in the axial direction relative to the spindle housing 51, which is fixed to the arm 34, without changing the positional relationship relative to the bearing support 61.

In the polishing apparatus 31 of the present invention, the bearing support 61 is arranged to be able to rotate forward and backward, for example, by changing over the direction of rotation of the drive shaft 54*a* of the drive motor 54, or by providing, in place of the drive gear 54*b*, a gear box which can selectively convert the rotation of the drive shaft 54*a* into any of forward and backward rotations and then transmit the rotation in the selected direction to the driven gear 54*c*. Further, the drive motor 54 comprises, for example, a servo motor or the like for easier control of an amount by which the bearing support 61 is rotated.

The spindle-side coupling portion 53 for coupling to the polishing head 5 is formed at a lower end of the spindle 38 projecting downward of the arm 34. The spindle-side coupling portion 53 comprises an outer cylindrical portion 66 coupled to the spindle body 38*a*, and a cylindrical position adjusting member 67 disposed within the outer cylindrical portion 66. Also, a spacer 69 is provided as an integral upper portion of the position adjusting member 67. By changing a thickness of the spacer, a position of the polishing head 5 coupled to the spindle-side coupling portion 53 can be adjusted.

A female threaded portion 68 for head attachment is formed in an inner peripheral surface of the outer cylindrical portion 66, and a male threaded portion formed on the polishing head 5 is meshed with the female threaded portion 68. (Note that the coupling structure between the outer cylindrical portion 66 and the polishing head 5 is not limited to the above-described one, but may be implemented by using any suitable one of structures that are usually employed for coupling two members).

Further, an annular recess 66*a* is formed in an upper surface of the outer cylindrical portion 66 in its outer peripheral area and receives an inner one of the above-mentioned two annular projections 51*a,* thereby providing a labyrinth structure. More specifically, a gap having a complicated shape is formed by the annular projections 51*a* and the annular recess 66*a* so that viscous frictional resistance and surface tension are developed in the gap. As a result, a liquid such as a slurry, foreign matter, etc. are prevented from intruding into the side of the first bearing 56.

With the polishing apparatus 31 thus constructed, the wafers W are polished as follows.

First, the wafers W not yet subjected to the polishing are taken out of the in-cassettes 36*a* by the robot arm 37 and are placed on the two retainer stands 44 of the cleaning station 33*a* in one-to-one relation. Then, the arm 34 is turned such that the two polishing heads 5 provided at one side end are positioned to face the wafers W on the two retainer stands 44 in vertically spaced relation. From this state, the polishing heads 5 are lowered and hold the wafers W respectively thereon (step 1).

In the above step, the polishing heads 5 may be constructed to be movable in the vertical direction by providing, on the arm 34, a mechanism for moving the arm 34 up and down along the rotating shaft 34*a* and then operating the mechanism to move the arm 34 up and down.

Next, after raising the polishing heads 5, the arm 34 is turned approximately 90 degrees clockwise as viewed in FIG. 1, causing the polishing heads 5 to be positioned above the platen 3 of the polishing station 32*a*. From this state, the polishing heads 5 are lowered to such an extent that the wafers W held by the polishing heads 5 are brought into contact with the surface of the polishing pad 4 on the platen 3.

In parallel, the polishing heads 5 and the platen 3 are each driven for rotation, whereby the polishing pad 4 and the wafers W are moved relative to each other to perform rough polishing of the wafers W (step 2).

Then the polishing heads 5 are each adjusted to set the positional relationship between the wafer W and the polishing pad 4 into an optimum one while confirming the state of polishing of the wafer W. The state of polishing of the wafer W can be confirmed, for example, by monitoring an output of a polishing resistance sensor or by visual observation. The position of the polishing head 5 in the vertical direction is adjusted through meshing between the position-adjustment male threaded portion 62 and the position-adjustment female threaded portion 63. Therefore, the vertical position of the polishing head 5 can be finely adjusted on the order of microns, for example, with ease.

Even when the two polishing heads 5 are carried into the polishing station 32*a* and subjected to the polishing at the same time, the polishing of the wafer W held by one of the two polishing heads 5 is sometimes finished earlier than the polishing of the wafer W held by the other polishing head 5. In such a case, the polishing head 5 holding the wafer W, for which the polishing has finished earlier, is raised to move the wafer W upward away from the polishing pad 4 to avoid the further polishing of the wafer W for which the polishing has already finished.

The above-described control is performed likewise in the subsequent polishing step as needed.

After the polishing of the wafers W has been completed, the polishing heads 5 are raised to move the wafers W upward away from the polishing pad 4, and the arm 34 is then turned approximately 90 degrees clockwise, causing the polishing heads 5 to be positioned above the cleaning station 33*b*.

Figure 5C:
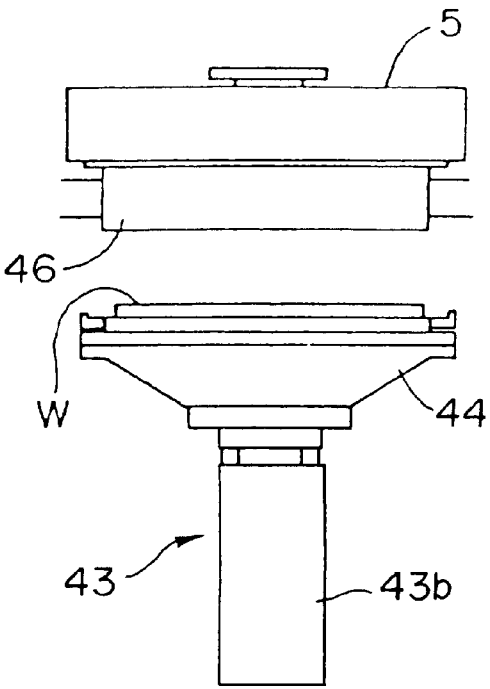
FIG. 5C is an enlarged side sectional view of principal part, showing a manner of cleaning the wafer (material to be cleaned) and the polishing head by a cleaning device in the polishing apparatus according to the first embodiment of the present invention.
Figure 5B:
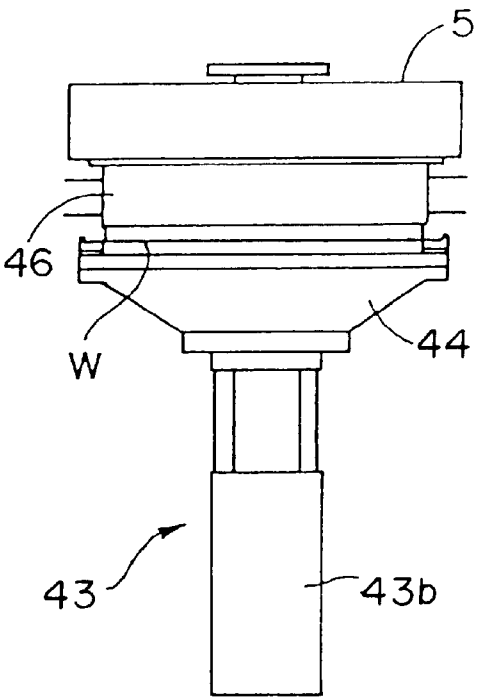
FIG. 5B is an enlarged side sectional view of principal part, showing a manner of cleaning the wafer (material to be cleaned) and the polishing head by a cleaning device in the polishing apparatus according to the first embodiment of the present invention.
Figure 5A:
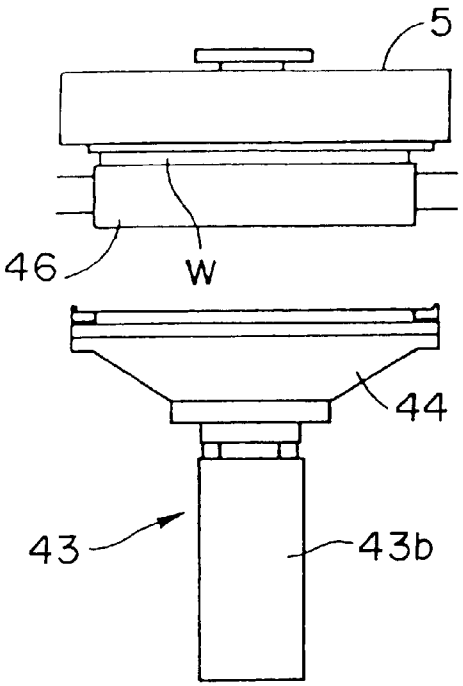
FIG. 5A is an enlarged side sectional view of principal part, showing a manner of cleaning a wafer (material to be cleaned) and a polishing head by a cleaning device in the polishing apparatus according to the first embodiment of the present invention.

Subsequently, the cleaning roller 46 of the cleaning device 45 in the cleaning station 33*b* is moved along the rails 48 while being rotated about its own axis by the drive motor 49 of the cleaning-member driving device 47 associated with the cleaning device 45. With the continued movement, the cleaning roller 46 is advanced to pass between the underside of each polishing head 5 and the top of each retainer stand 44 in the cleaning station 33*b*. At this time, as shown in FIG. 5A which is an enlarged side sectional view of principal part, the cleaning roller 46 comes into contact with the underside of the wafer W held by the polishing head 5, thereby cleaning the underside of the wafer W (step 3).

Next, after retracting the cleaning roller 46 from the position between the underside of the polishing head 5 and the top of the retainer stand 44, the retainer stand 44 is raised to come close to the polishing head 5 and the wafer W is transferred from the polishing head 5 onto the retainer stand 44. Then, the cleaning roller 46 is advanced again to pass between the underside of the polishing head 5 and the top of the retainer stand 44 while an appropriate spacing is left between the polishing head 5 and the retainer stand 44, as shown in FIG. 5B. As a result, both the underside of the polishing head 5 including an area which has been so far covered by the wafer W and the upper side of the wafer W (including lateral surfaces thereof) are cleaned.

Subsequently, the retainer stand 44 including the wafer W held thereon is lowered, and only the underside of the polishing head 5 is cleaned again (see FIG. 5C).

After cleaning the polishing head 5, the retainer stand 44 is raised to come close to the polishing head 5, and the wafer W is held by the polishing head 5 (step 4).

In parallel to the steps 3 and 4, the step 1 is carried out. More specifically, new wafers W not yet subjected to the polishing are taken out of the in-cassettes 36*a* by the robot arm 37, placed on the retainer stands 44 of the cleaning station 33*a,* and then held by the polishing heads 5. At the same time, in the polishing station 32*a,* the surface of the polishing pad 4 is conditioned by the conditioner 41 (step 5). By so carrying out the cleaning of the wafers W and the conditioning of the surface of the polishing pad 4 in parallel, the effect of the wafer cleaning work upon a total working time is reduced and a reduction in throughput is minimized.

Next, after raising the polishing heads 5 provided at both the side ends of the arm 34, the arm 34 is turned approximately 90 degrees clockwise as viewed in FIG. 1 such that the polishing heads 5 at the end which has been just subjected to the cleaning of the wafers W in the cleaning station 33*b* are positioned above the polishing pad 4 of the polishing station 32*b,* whereas the polishing heads 5 holding the wafers W not yet subjected to the polishing are positioned above the polishing pad 4 of the polishing station 32*a*. From this state, similarly to the step 2, fine polishing of the wafers W having been cleaned in the cleaning station 33*b* is performed in the polishing station 32*b,* and rough polishing of the wafers W not yet subjected to the polishing is performed in the polishing station 32*a* (step 6).

In the step 6, the polishing station 32*a* requires a longer time for polishing the wafers W than the polishing station 32*b*, the polishing heads 5 located in the polishing station 32*b* are raised to move away from the polishing pad 4 at the time when the polishing of the wafers W in the polishing station 32*b* is completed. An amount by which the wafers W are each polished in the polishing station 32*b* are thereby adjusted to an optimum value.

On the side of the polishing station 32*b*, to remove micro-scratches in the surface of each wafer W after the fine polishing of the wafers W has been completed, buff polishing (finish polishing) of the wafers W is carried out by further polishing the wafers W while the slurry supplied to the polishing pad 4 in the polishing station 32*b* is replaced by pure water.

Then, after the polishing of the wafers W in both the polishing station 32*a* and the polishing station 32*b* has been completed, the polishing heads 5 provided at both the side ends of the arm 34 are raised to move the wafers W upward away from the surface of the polishing pad 4. From this state, the arm 34 is turned approximately 90 degrees clockwise such that the wafers W for which the polishing in the polishing station 32*b* has finished are positioned above the cleaning station 33*a*, whereas the wafers W for which the polishing in the polishing station 32*a* has finished are positioned above the cleaning station 33*b*. Then, similarly to the steps 3 and 4, the wafers W are cleaned by the respective cleaning devices 45.

In parallel to the above operation, like in the step 5, the conditioning of the surface of the polishing pad 4 is performed in each of the polishing stations 32*a*, 32*b* (step 7). Then, after completion of the cleaning of the wafers W, the wafers W which have been polished and are located in the cleaning station 33*a* are carried into the out-cassettes 36*b* by the robot arm 37 (step 8). After that, the polishing of the wafers W is continued by repeating the above-described operations of the steps 5 to 8.

In the polishing apparatus 31 having the above-described construction, the cleaning device 45 provided in each of the cleaning stations 33*a*, 33*b* makes it possible to clean the wafers W held by the polishing heads 5, clean the wafers W held on the support stand 44, and clean the polishing heads 5 where the wafers W are separated from the polishing heads 5. Accordingly, the slurry intruded between the wafers W and the polishing heads 5 can also be removed by the cleaning. Further, the upper side of the wafer W and the underside of the polishing head 5 can be cleaned at the same time.

Also, the polishing stations 32*a*, 32*b* and the cleaning stations 33*a*, 33*b* are alternately arranged, and the cleaning of the wafers W is performed in parallel to the operation of conditioning the surface of the polishing pad 4 in each of the polishing stations 32*a*, 32*b*. Therefore, the effect of the wafer cleaning work upon a total working time is reduced and a reduction in throughput is minimized.

Further, since the polishing stations 32*a*, 32*b* and the cleaning stations 33*a*, 33*b* are arranged to lie substantially on a circle about the rotating shaft 34*a* of the arm 34, those stations can be arranged in close relation relative to each other and the area required for installation of the polishing apparatus 31 can be reduced.

Thus, according to the polishing apparatus 31 having the above-described construction, the risk that different slurries may mix with each other between the polishing stations 32*a*, 32*b* can be reduced. Therefore, the wafers W can be satisfactorily polished even in the case of polishing the wafers W under plural sets of different polishing conditions successively, for example, in the case of using an alkaline slurry (or an acid slurry) in the polishing stations 32*a* and a neutral or acid slurry (or an alkaline slurry) in the polishing stations 32*b*.

Also, since the upper side of the wafer W and the underside of the polishing head 5 can be cleaned at the same time, the time required for cleaning them is shortened and the work efficiency can be improved.

Further, since the area required for installation of the polishing apparatus 31 is reduced and the cost of an installation space for the polishing apparatus 31 is cut down, the production cost of the wafers W polished by the polishing apparatus 31 can be reduced. Additionally, the arm 34 can have a simple structure and the production cost of the polishing apparatus 31 can be cut down.

Moreover, the adjusting mechanism 54 for the polishing head 5 is provided for each of the spindles 38 that support respectively a plurality of the polishing heads 5. The adjusting mechanism 54 comprises the position-adjustment male threaded portion 62 formed on the outer periphery of the bearing support 61, the position-adjustment female threaded portion 63 formed in the inner periphery of the spindle housing 51 and meshed with the position-adjustment male threaded portion 62, and the drive motor 54 for rotating the bearing support 61 through the drive gear 54*b* and the driven gear 54*c*. With such an arrangement, the spindle shaft 38*a* is moved in the axial direction by rotating the bearing support 61. It is therefore possible to easily perform fine adjustment of the position of each polishing head 5, i.e., the relative positional relationship between the wafer W and the polishing pad 4. Hence, even with the construction including a plurality of polishing heads 5, the individual polishing heads 5 can be adjusted independently of one another, and all the wafers W held by the polishing heads 5 can be polished with stability.

Further, since the axial position of the spindle 38 is finely adjustable even during the polishing of the wafer W, the polishing apparatus 31 can be surely adapted to the case where the working conditions are changed during the polishing process. Here, changes in the working conditions include, for example, a slight excursion of the setting for each of the polishing heads 5 and gradual thinning of the polishing pad 4, which may occur during the polishing process continued for a long time.

In addition, the polishing heads 5 in the polishing apparatus 31 of the present invention can be adjusted to respective optimum levels independently of one another, and individual adjustment of the polishing heads 5 can be easily and inexpensively performed by using a stepping motor, for example.

Figure 6:
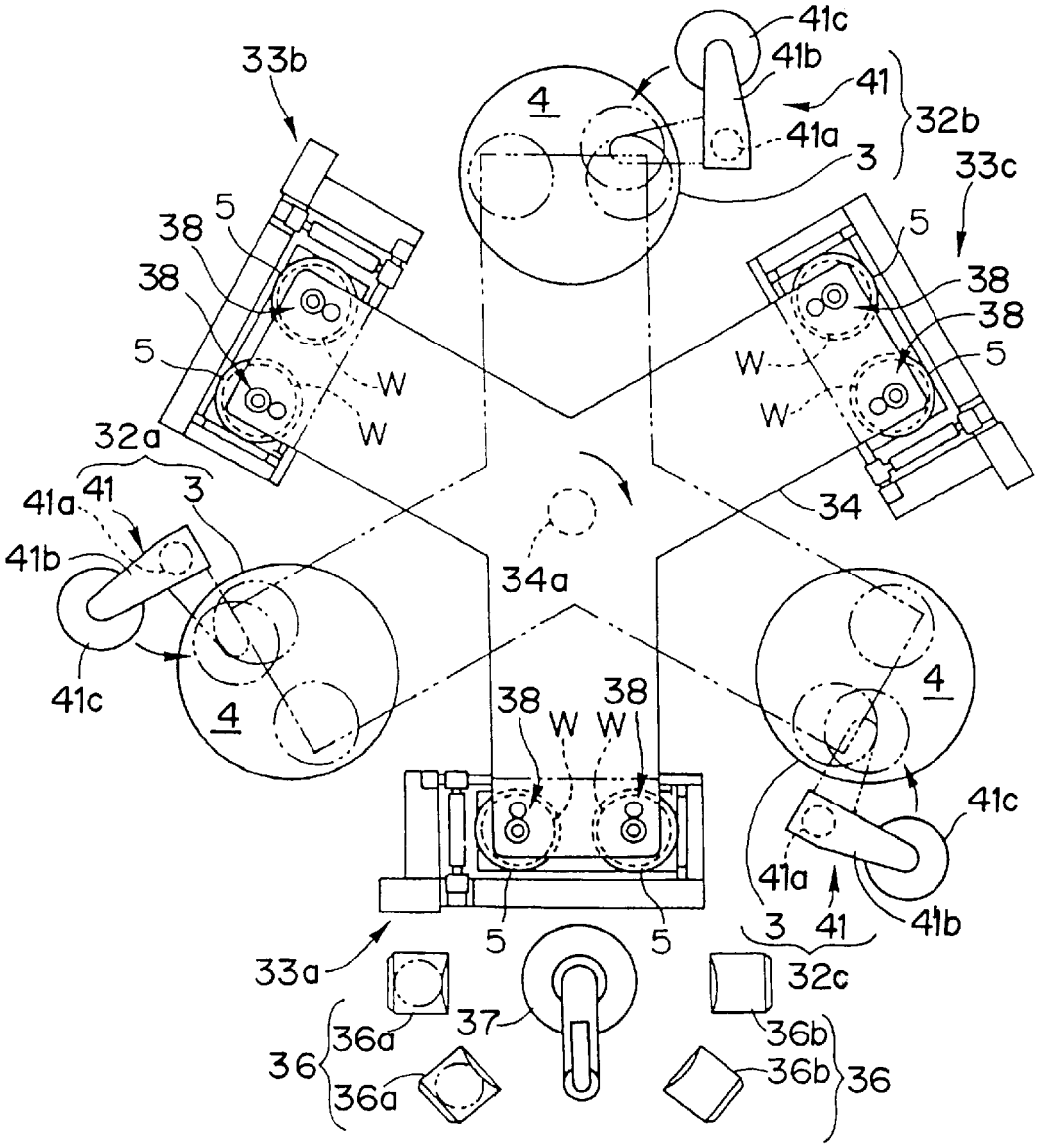
FIG. 6 is a plan view showing another form of the polishing apparatus according to the first embodiment of the present invention.

In the polishing apparatus 31 described above as the first embodiment, each two units of polishing stations and cleaning stations are alternately arranged to lie substantially on a circle about the rotating shaft 34*a* of the arm 34, and these four stations are disposed at phase differences (angular intervals) of about 90 degrees with respect to the arm rotating shaft 34*a*. The present invention is, however, not limited to such an arrangement. The polishing process of the wafers W may be divided into a larger number of stages as shown in FIG. 6, by way of example. More specifically, each three units of polishing stations and cleaning stations (e.g., polishing stations 32*a*, 32*b*, 32*c* and cleaning stations 33*a*, 33*b*, 33*c*) may be alternately arranged to lie substantially on a circle about the arm rotating shaft 34*a* at phase differences of about 60 degrees with respect to the arm rotating shaft 34*a*. Also, the polishing stations and the cleaning stations may be provided in a larger number than three.

In such a case, the polishing heads 5 are provided on the arm 34 to be able to take positions facing all the polishing stations (or all the cleaning stations) in one stage so that the wafers W can be processed in parallel in all the polishing stations or all the cleaning stations. Assuming, for example, that each three units of polishing stations and cleaning stations are provided, the arm 34 is formed into a substantially Y-shape having ends projecting in three directions at phase differences of about 120 degrees with respect to the arm rotating shaft 34*a*. The polishing heads 5 are then provided on the underside of the three ends of the arm 34.

As an alternative, the polishing apparatus 31 may be constructed by arranging the polishing stations and the cleaning stations in series, and then providing an arm for movement to pass these stations successively.

Instead of the drive motor 54, the drive gear 54*b* and the driven gear 54*c* provided in the above embodiment, a handle may be provided to project from the outer periphery of the bearing support 61, by way of example, so that the bearing support 61 is manually rotated.

Additionally, the adjusting mechanism for adjusting the axial position of the polishing head 5 is not limited to the construction described in the above embodiment, but may be constructed by any suitable one of structures that are usually employed for adjusting the position of a spindle in the axial direction thereof.

While the above embodiment uses the cleaning device 45 comprising the cleaning roller 46 and the cleaning-member driving device 47, the present invention is not limited to such an arrangement. The cleaning device may be constructed in any suitable arrangement so long as the cleaning member is able to advance and retract between the polishing head 5 and the retainer stand 44.

Figure 7:
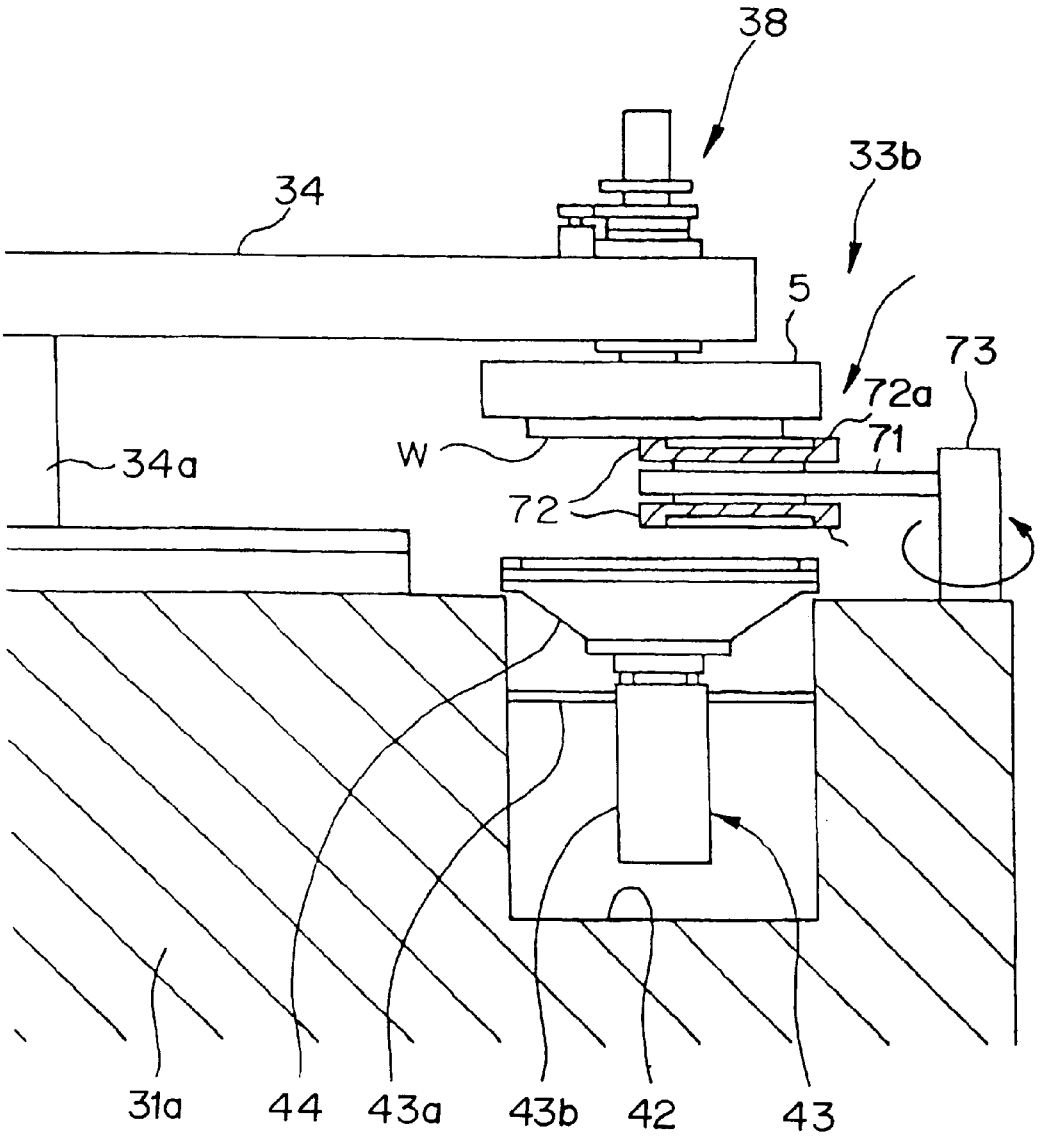
FIG. 7 is an enlarged side sectional view of principal part, showing another example of the cleaning device used in the polishing apparatus according to the first embodiment of the present invention.

As shown in FIG. 7, by way of example, a cleaning device 73 may comprise an arm 71 (cleaning-member driving device) having one base end supported by a shaft 71*a* as a fulcrum and the other fore end swung about the shaft 71*a* to be able to advance and retract between the polishing head 5 and the retainer stand 44, and a substantially disk-shaped cleaning member 72 attached to the fore end of the arm 71 and rotated about its own axis substantially parallel to the axis of the polishing head 5 by an associated driving device (not shown). In the arrangement shown in FIG. 7, two cleaning members 72 are attached respectively to upper and lower surfaces of the arm 71 in order to clean both the polishing head 5 and the wafer W held on the retainer stand 44. Also, the cleaning members 72 are each formed of a substantially cup-shaped member (made of sponge or the like) in which an outer peripheral portion 72*a* of its surface facing the polishing head 5 or the wafer W is projected in larger amount toward the polishing head 5 or the wafer W than an inner peripheral portion thereof. The outer peripheral portion 72*a* serves to clean the polishing head 5 or the wafer W.

In such a case, when cleaning the polishing head 5 or the wafer W, the cleaning member 72 is moved by the arm 71 to a position offset from the polishing head 5 and the retainer stand 44, and is rotated about its own axis while the outer peripheral portion 72*a* is held in contact with the underside of the polishing head 5 or the upper side of the wafer W. By rotating the polishing head 5 or the retainer stand 44 about its own axis with an associated driving device (not shown) in the above state, the entire underside of the polishing head 5, or the entire underside of the wafer W held by the polishing head 5, or the entire upper side of the wafer W held by the retainer stand 44 is cleaned by the cleaning member 72.

Second Embodiment

Figure 8:
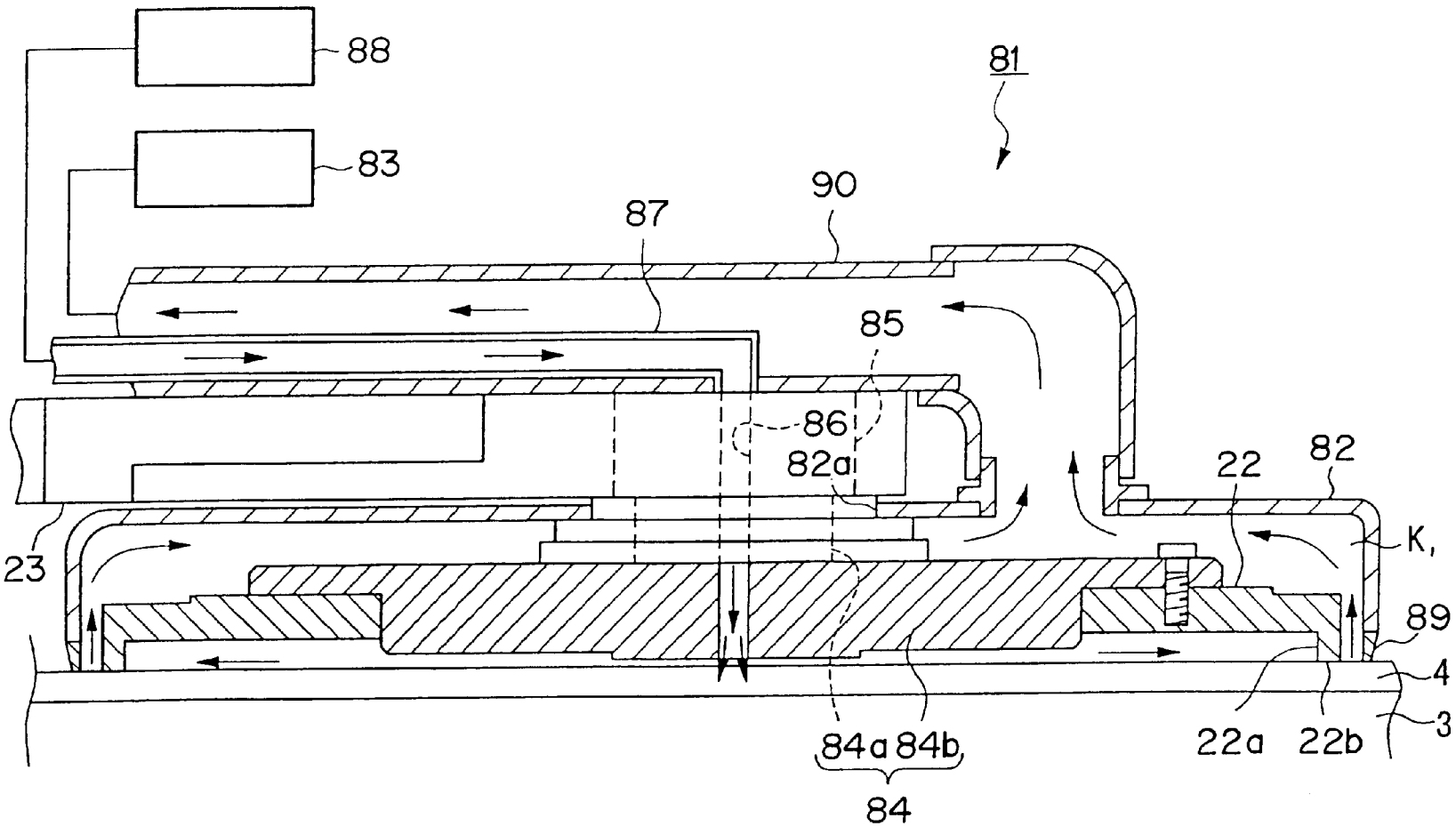
FIG. 8 is a side sectional view showing a construction of principal part of a conditioner used in a polishing apparatus according to a second embodiment of the present invention.

A second embodiment of the present invention will be described below with reference to the drawings. The same or equivalent components as or to those in the related art or the first embodiment described above are denoted by the same reference numerals and a description thereof is omitted here. A polishing apparatus of this second embodiment differs from that of the first embodiment in employing the conditioner 81 described below, instead of the conditioner 41, in each polishing station of the polishing apparatus 31. The following description is therefore made primarily of the conditioner 81. FIG. 8 is a side sectional view showing a construction of principal part of the conditioner 81 used in the polishing apparatus according to the second embodiment of the present invention.

The conditioner 81 of this embodiment has basically the same construction as, for example, the conditioner 21 shown in FIG. 23. More specifically, a rotating shaft (not shown) is provided outside a platen 3, and a dresser 22 (loading eliminating means) is operatively coupled to the rotating shaft through an arm 23. In addition, the arm 23 is provided with a cover 82 covering the dresser 22 and forming a space K1 between the cover 82 and a surface of a polishing pad 4 in isolation from the exterior, and also with a suction device 83 connected to the space K1 formed between the cover 82 and the polishing pad 4 for sucking foreign matter on the surface of the polishing pad 4.

The dresser 22 is attached to a fore end of the arm, and a support shaft 84 for supporting the dresser 22 is provided at the fore end. Also, the arm 23 includes a lifting device 85 for supporting the support shaft 84 to be able to move up and down relative to the arm 23, while allowing the support shaft 84 to rotate about its own axis.

The support shaft 84 comprises a support shaft body 84*a* provided at the fore end of the arm 23 and a flange 84*b* provided at a lower end of the support shaft body 84*a* and projecting radially outward from the support shaft body 84*a*. A lower end surface of the support shaft 84 is exposed to the polishing pad 4, and a flow hole 86 is formed through the support shaft 84 and the lifting device 85 to extend from the lower end of the support shaft 84 to an upper end of the lifting device 85. Additionally, a driving device may be coupled to the support shaft 84 for rotating it so that the dresser 22 attached to the support shaft 84 is rotated by the driving device.

One end of a cleaning liquid pipe 87 is connected to an upper end of the flow hole 86. The cleaning liquid pipe 87 is extended along the arm 23 to the outside of the platen 3. The other end of the cleaning liquid pipe 87 is connected to a cleaning liquid supply source 88, enabling a cleaning liquid to be supplied to the lower end of the support shaft 84 through the cleaning liquid pipe 87 and the flow hole 86. In this embodiment, the cleaning liquid is supplied from the cleaning liquid supply source 88 under a sufficiently high pressure (e.g., not lower than several tens MPa) so that the cleaning liquid can be jetted under high pressure from the lower end of the support shaft 84. In this embodiment, the cleaning liquid supply source 88, the cleaning liquid pipe 87 and the flow hole 86 construct a cleaning-liquid jetting means for spraying the cleaning liquid toward the polishing pad 4. Where the cleaning liquid is just required to be supplied to the surface of the polishing pad 4, the pressure of the cleaning liquid supplied from the cleaning liquid supply source 88 can be freely set.

The lifting device 85 is constructed, for example, by an actuator or the like that supports the support shaft 84 with a bearing in a rotatable manner and moves the support shaft 84 axially when the actuator or the like is extended and contracted in the axial direction of the support shaft 84. (Note that the lifting device 85 is not limited to such a mechanism, but may be constructed by any suitable one of mechanisms that are usually employed in the art).

The dresser 22 is substantially in the form of a circular ring, and has a projection 22*a* formed on the underside of the dresser 22 along its outer peripheral edge. Diamond particles are fixed to a lower surface of the projection 22*a* by electrical deposition, for example, to form a dressing surface 22*b* for chipping off the surface of the polishing pad. The shape of the dresser 22 and the construction of the dressing surface 22*b* are described above only by way of example, and they can be selected from among any suitable shapes and constructions.

The cover 82 is a generally disk-shaped member having an outer peripheral portion bent downward and an insertion hole 82*a* formed at its center to receive the support shaft 84 projected from the arm 23 and a part of the arm 23. The insertion hole 82*a* is fitted to a fore end portion of the arm 23 in airtight fashion, whereby the cover 82 is fixed to the arm 23 with a spacing left relative to both an outer periphery and an upper surface of the dresser 22.

Further, the cover 82 has a skirt 89 formed along an overall circumference of its lower end to be able to come into contact with the polishing pad 4. Thus, the lower end of the cover 82 is brought into close contact with the polishing pad 4 through the skirt 89. Although the skirt 89 is able to come into contact with the polishing pad 4, it will not seal off the space K1 in a perfectly airtight manner. Also, the skirt 89 is made of a material, such as rubber or a plastic, which is pliable to such an extent that the surface of the polishing pad 4 is not damaged upon contact of the skirt 89 with the polishing pad 4.

Further, one end of a suction pipe 90 is connected to the cover 82 for communication with the space K1 within the cover 82, and the other end of the suction pipe 90 is connected to a suction device 83. The suction device 83 comprises, for example, a vacuum pump or the like.

Conditioning the surface of the polishing pad by the conditioner thus constructed will be described below. The conditioner 81 separates foreign matter from the polishing pad 4 by employing both the dresser 22 and the cleaning-liquid jetting means.

The separation of foreign matter from the polishing pad 4 using the dresser 22 is carried out basically in the same way as with the conventional conditioner 21. First, the dresser 22 is lowered within the cover 82 by the lifting device 85, bringing the dressing surface 22*b* of the dresser 22 into contact with the polishing pad 4. By turning the arm 23 in that state, the dresser 22 swings reciprocally on the rotating polishing pad 4 so that the dresser 22 slightly chips off the surface of the polishing pad 4. In the illustrated embodiment, the dresser 22 is forced to rotate by frictional forces developed between the dresser 22 and the polishing pad 4 while being kept in contact with the surface of the polishing pad 4, thereby chipping off a surface of the polishing pad 4, (though the dresser 22 may be positively driven for rotation by a not-shown driving device).

By so chipping off the surface of the polishing pad 4, the foreign matter adhering to the surface of the polishing pad 4 is separated from the polishing pad 4 to release it from the loaded state, and at the same time a fresh surface is formed on the polishing pad 4 to release it from the dulled state. As a result, the polishing ability of the polishing pad 4 is restored (through the so-called dressing).

In parallel to the above dressing process, cleaning liquid is sprayed toward the surface of the polishing pad 4 under high pressure by the cleaning-liquid jetting means, and the foreign matter adhering to the polishing pad 4 is washed out with the high pressure of the sprayed cleaning liquid. The cleaning liquid washes out not only the foreign matter loaded on the polishing pad 4, but also the foreign matter separated from the polishing pad 4 by the dresser 22 (including chips of the polishing pad 4 itself).

Where the polishing pad 4 is formed from a piece of non-woven cloth, the pad is dulled because fibers at the pad surface are crushed or pushed down and become less nappy. With the conditioner 81, however, the cleaning liquid is sprayed toward the polishing pad 4, whereupon the fibers at the pad surface are raised from the pushed-down state and the fibers of the piece of non-woven cloth are restored to become nappy again. Accordingly, the cleaning-liquid jetting means serves also to eliminate (or remove) the loading of the polishing pad 4.

Since the elimination of the loading of the polishing pad 4 by using both the dresser 22 and the cleaning-liquid jetting means is performed within the cover 82, the foreign matter separated from the polishing pad 4 and the cleaning liquid is not scattered to the surroundings. The foreign matter thus separated from the polishing pad 4 is instead dispersed into the cleaning liquid and drifts to the outer periphery of the dresser 22, for example with the flow of the cleaning liquid, upon movement of the dresser 22 on the polishing pad 4 due to the swing of the arm 23, and under centrifugal forces generated upon the rotation of the platen 3 or the rotation of the dresser 2. Eventually, the foreign matter moves to the gap between the outer periphery of the dresser 22 and the cover 82.

Because the space K1 formed between the cover 82 and the polishing pad 4 communicates with the suction device 83, the foreign matter having moved to the gap between the outer periphery of the dresser 22 and the cover 82 is sucked by the suction device 83 through the suction pipe 90 together with the cleaning liquid. Thus, the foreign matter is quickly removed from the surface of the polishing pad 4.

When finishing the work of eliminating the loading of the polishing pad 4, if the work of eliminating the loading of the polishing pad 4 and the work of sucking the foreign matter by the suction device 83 are stopped simultaneously, the foreign matter separated from the polishing pad 4 by the loading eliminating means just before the stop of the eliminating work is left on the polishing pad 4. To avoid such a drawback, the work of sucking the foreign matter by the suction device 83 is continued even after stopping the operation of the loading eliminating means, and the operation of the suction device 83 is stopped only after the foreign matter left on the polishing pad 4 has been completely removed.

More specifically, the work of separating the foreign matter from the polishing pad 4 is first stopped by lifting the dresser 22 within the cover 82 with the lifting device 85 to move the dresser 22 away from the polishing pad 4 and stopping the spray of the cleaning liquid by the cleaning-liquid jetting means. Then, by swinging the arm 23 reciprocally, the foreign matter remaining on the polishing pad 4 is sucked and removed by the suction device 83.

With the conditioner 81 thus constructed, the foreign matter separated from the polishing pad 4 by both the dresser 22 and the cleaning-liquid jetting means is quickly sucked by the suction device 83. It is therefore possible to remove the foreign matter quickly and efficiently from the polishing pad 4.

Also, since the elimination of the loading of the polishing pad 4 by using both the dresser 22 and the cleaning-liquid jetting means is performed within the cover 82, the foreign matter and the cleaning liquid are not scattered to the surroundings, and contamination of the polishing pad 4 is suppressed. Thus, an adverse effect of the scattered foreign matter upon the polishing apparatus can be reduced. Further, since the foreign matter is sucked by the suction device 83 within the cover 82 and is not scattered, the foreign matter can be more efficiently removed.

Moreover, since the dresser 22 having a high ability for conditioning the surface state of the polishing pad 4, as the loading eliminating means, and the chips of the polishing pad 4 are quickly and efficiently removed, the ability of the dresser 22 to condition the surface state of the polishing pad 4 can be further increased.

Additionally, since the foreign matter separated from the polishing pad 4 is dispersed into the cleaning liquid and then sucked by the suction device 83 together with the cleaning liquid, the ability of recovering the foreign matter can be improved.

Figure 9:
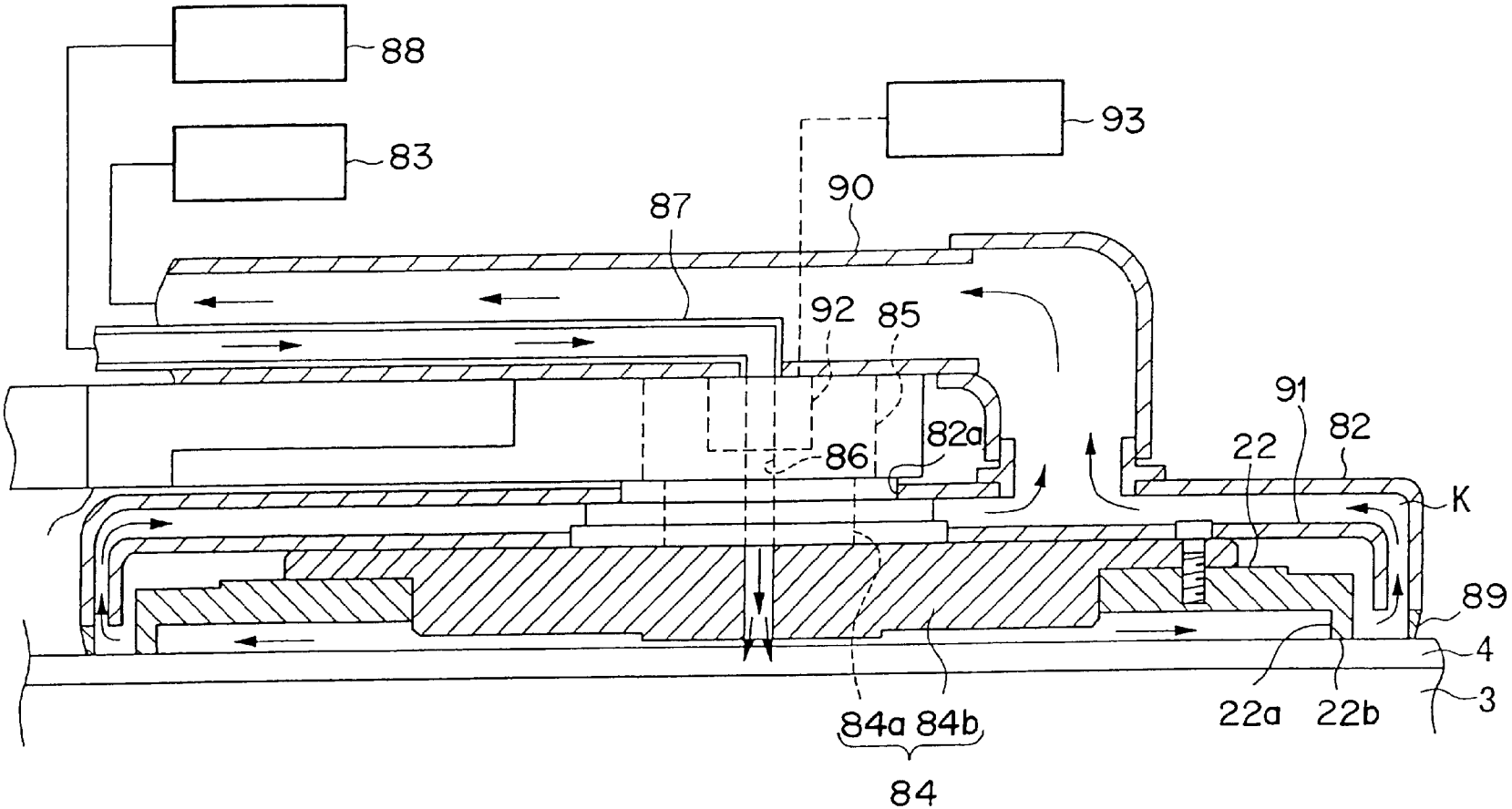
FIG. 9 is a side sectional view showing another form of the construction of the second embodiment of the present invention.

In the embodiment described above, the foreign matter is sucked by the suction device 83 from the gap formed between the dresser 22 and the cover 82. With such an arrangement, however, the foreign matter is deposited on upper and outer peripheral surfaces of the dresser 22 during use for a long period of time, and additional work of cleaning the dresser 22 to remove the deposited foreign matter is needed. In view of this, the arrangement may be modified as shown in FIG. 9, by way of example, such that a dresser cover 91 for covering the dresser 22 is provided between the dresser 22 and the cover 82, and the foreign matter is sucked by the suction device 83 from a gap formed between the dresser cover 91 and the cover 82. This modified arrangement is effective in suppressing deposition of the foreign matter on the dresser 22 itself and lessening the necessity of cleaning the dresser 22.

Also, while in the above embodiment the cleaning-liquid jetting means just sprays the cleaning liquid under high pressure toward the polishing pad 4, the cleaning-liquid jetting means is not limited to such a structure. As shown in FIG. 9, by way of example, a ultrasonic wave generator may be disposed between the cleaning liquid pipe 87 and the flow hole 86 so that ultrasonic oscillations can be applied to the cleaning liquid. The ultrasonic wave generator may comprise an oscillator 92 disposed between the cleaning liquid pipe 87 and the flow hole 86 for applying ultrasonic oscillations in the vertical direction to the cleaning liquid supplied to the flow hole 86, and a ultrasonic wave generator body 93 electrically connected to the oscillator 92 through the arm 23 for controlling the operation of the oscillator 92.

With such an arrangement, the foreign matter is scraped off to float from the surface of the polishing pad 4 by vibrating the foreign matter adhering to the polishing pad 4 with the ultrasonic oscillations applied to the cleaning liquid, and by generating a cavitation in the cleaning liquid with the ultrasonic energy and vibrating the foreign matter under a local impact pressure caused upon generation of the cavitation. Thus, since the ultrasonic oscillations also contribute to separating the foreign matter from the polishing pad 4 in addition to the cleaning by the cleaning liquid, the loading of the polishing pad 4 can be more effectively eliminated.

Where the polishing pad 4 is formed using a piece of non-woven cloth, fibers at the pad surface are raised and the fibers of the piece of non-woven cloth are restored to become nappy again with the ultrasonic oscillations applied to the cleaning liquid. Accordingly, the loading of the polishing pad 4 can be more effectively eliminated (or removed).

Third Embodiment

A third embodiment of the present invention will be described below with reference to FIGS. 10 and 11. A polishing apparatus of this third embodiment differs from that of the first embodiment in employing the conditioner 96 described below, instead of the conditioner 41, in each polishing station of the polishing apparatus 31. The following description is therefore made primarily of the conditioner 96.

Figure 10:
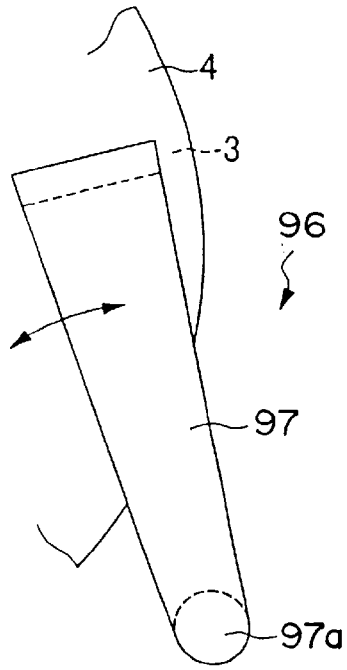
FIG. 10 is a plan view showing a construction of a conditioner used in a polishing apparatus according to a third embodiment of the present invention.
Figure 11:
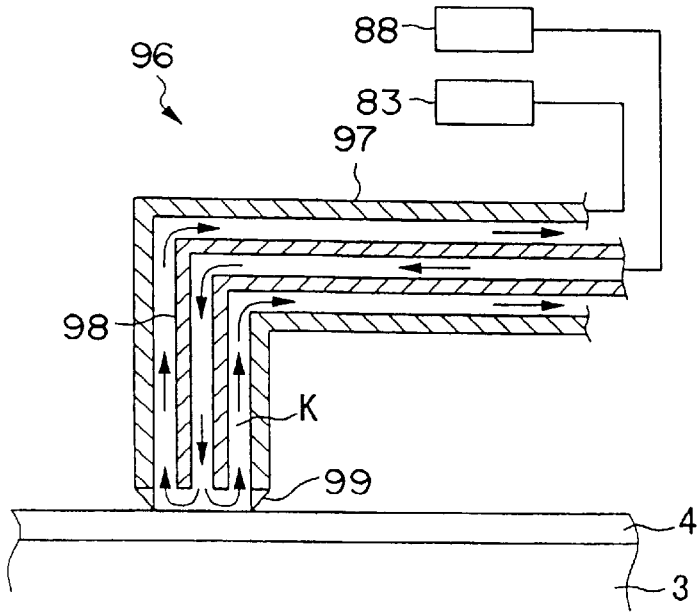
FIG. 11 is a side sectional view showing the construction of the conditioner used in the polishing apparatus according to the third embodiment of the present invention.

As shown in plan view in FIG. 10, the conditioner 96 has a hollow arm 97 which is attached at its base end to a rotating shaft 97*a* provided outside the platen 3, and has a fore end portion bent downward with its lower end opened. As shown in a side sectional view of FIG. 11, the arm 97 includes therein a cleaning liquid pipe 98 having a fore end portion that is also bent downward and opened at its lower end. An opposite base end of the cleaning liquid pipe 98 is connected to the cleaning liquid supply source 88 described in the first embodiment. The cleaning liquid is supplied from the cleaning liquid supply source 88 under a sufficiently high pressure (e.g., not lower than several tens MPa) so that the cleaning liquid can be jetted under high pressure from the lower end of the cleaning liquid pipe 98. In this embodiment, the cleaning liquid supply source 88 and the cleaning liquid pipe 98 form a cleaning-liquid jetting means for spraying the cleaning liquid toward the polishing pad 4.

The arm 97 also serves as a cover so that the fore end portion of the arm 97 covers the fore end portion of the cleaning liquid pipe 98 and forms a space K2 between the arm 97 and the cleaning liquid pipe 98 above the polishing pad 4 to isolate it from the outside. At the foremost end (lower end of the fore end portion) of the arm 97, a skirt 99 is formed along the entire circumference of an arm opening to be able to come into contact with the polishing pad 4. Thus, the lower end of the arm 97 is brought into close contact with the polishing pad 4 through the skirt 99. Although the skirt 99 is able to come into contact with the polishing pad 4, it will not seal off the space K2 in a perfectly airtight manner. Also, the skirt 99 is made of a material, such as rubber or a plastic, which is pliable to such an extent that the surface of the polishing pad 4 is not damaged upon contact of the skirt 99 with the polishing pad 4.

The arm 97 is connected to a suction device 83 for sucking the foreign matter from the polishing pad 4 in the space K2 formed between the arm 97 and the cleaning liquid pipe 98.

In the conditioner 96 having the construction described above, the foreign matter is separated from the polishing pad 4 by the cleaning-liquid jetting means. That is to say, the cleaning liquid is sprayed under high pressure toward the surface of the polishing pad 4 by the cleaning-liquid jetting means, and the foreign matter adhering to the polishing pad 4 is washed out with the high pressure of the cleaning liquid.

Where the polishing pad 4 is formed using a piece of non-woven cloth, the pad is dulled because fibers at the pad surface are crushed or pushed down and become less nappy. With the conditioner 96, however, the cleaning liquid is sprayed toward the polishing pad 4, whereupon the fibers at the pad surface are raised from the pushed-down state and the fibers of the piece of non-woven cloth are restored to become nappy again. As a result, the loading of the polishing pad 4 is eliminated.

Since the elimination of the loading of the polishing pad 4 by using the cleaning-liquid jetting means is performed within the arm 97, the foreign matter separated from the polishing pad 4 and the cleaning liquid is not scattered to the surroundings. Instead, the foreign matter separated from the polishing pad 4 is dispersed into the cleaning liquid, sucked by the suction device 83 together with the cleaning liquid within the arm 97, and then quickly removed from the surface of the polishing pad 4.

When finishing the work of eliminating the loading of the polishing pad 4, the work of sucking the foreign matter by the suction device 83 is continued even after stopping the spray of the cleaning liquid by the loading eliminating means, and the overall operation of the conditioner 96, i.e., the operation of the suction device 83, is stopped only after the foreign matter left on the polishing pad 4 has been completely removed.

The conditioner 96 of this embodiment can be of a simpler construction than the conditioner 81 employed in the first embodiment.

Additionally, while in the above embodiment the cleaning-liquid jetting means just sprays cleaning liquid under high pressure toward the polishing pad 4, the cleaning-liquid jetting means is not limited to such an structure. As with the example shown in FIG. 9, an ultrasonic wave generator may be disposed in the cleaning liquid pipe 98 so that ultrasonic oscillations can be applied to the cleaning liquid.

Fourth Embodiment

Figure 12:
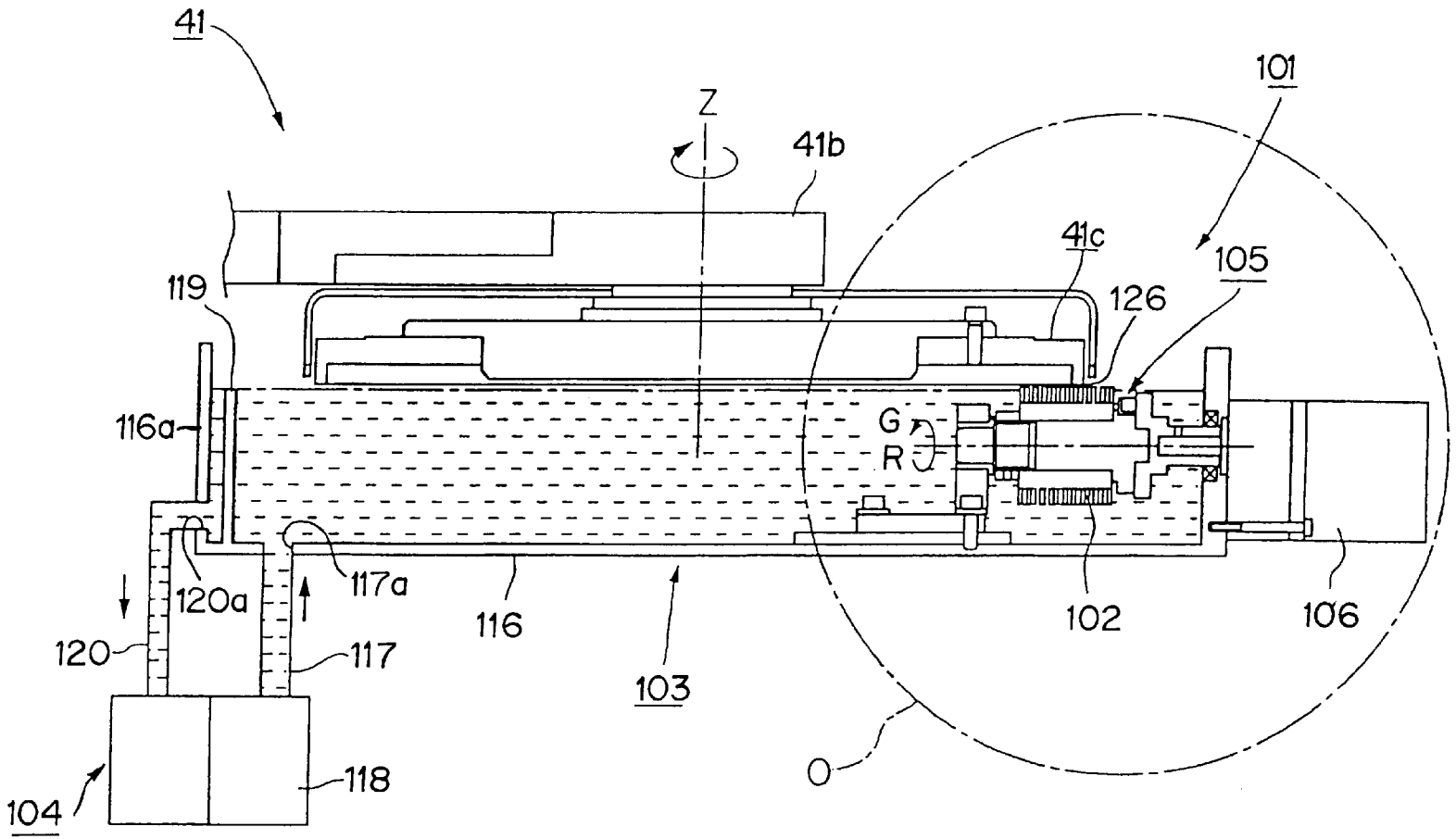
FIG. 12 is a sectional view of a conditioner cleaning device used in a polishing apparatus according to a fourth embodiment of the present invention.
Figure 13:
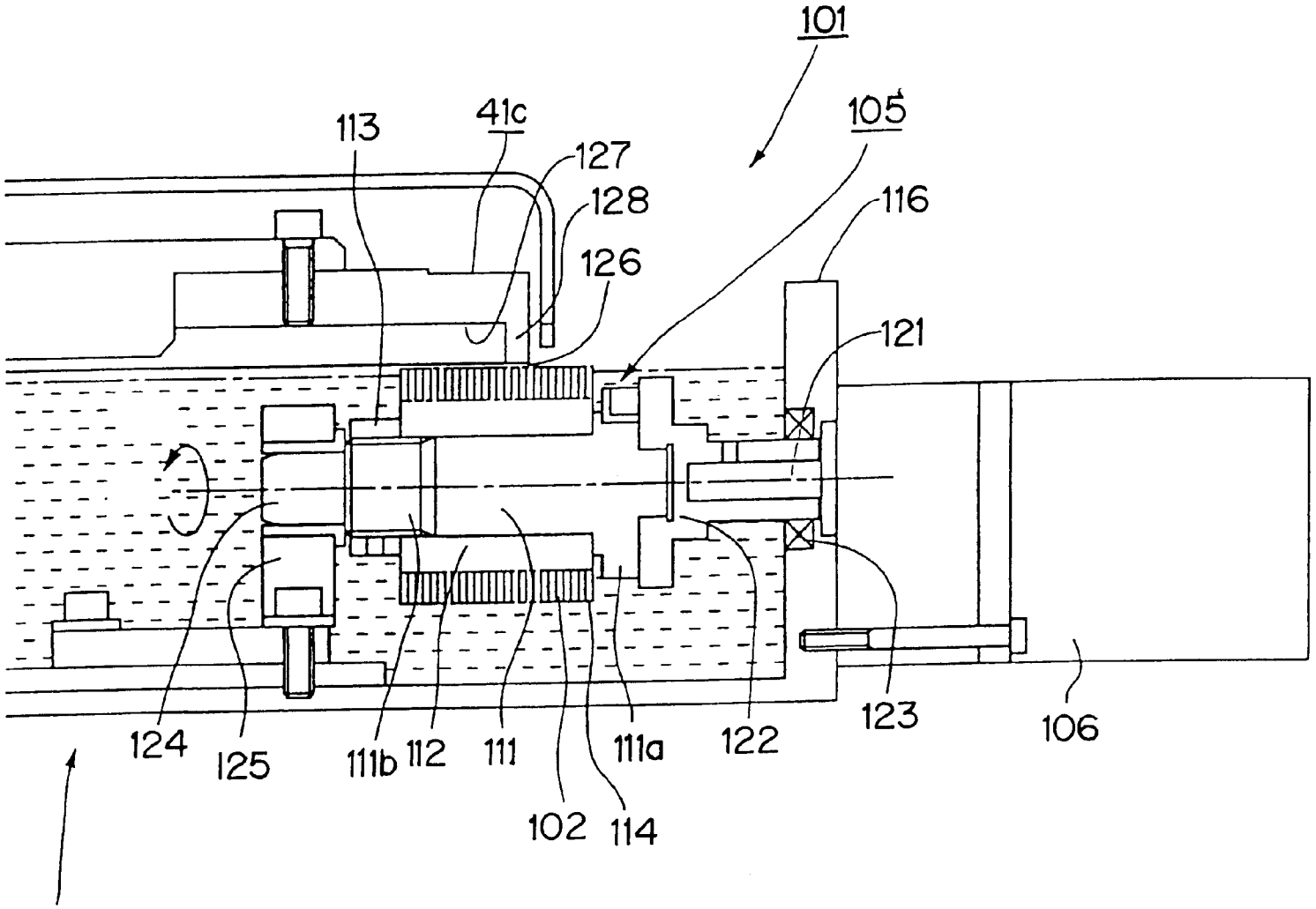
FIG. 13 is a sectional view showing a portion O in FIG. 12 in enlarged scale.

A fourth embodiment of the present invention will be described below with reference to the drawings. The same or equivalent components as or to those in the related art or the first embodiment described above are denoted by the same reference numerals and a description thereof is omitted here. A polishing apparatus of this fourth embodiment differs from that of the first embodiment in providing, in each polishing station of the polishing apparatus 31, a conditioner cleaning device for cleaning the conditioner 41. The following description is therefore made primarily of the conditioner cleaning device. FIGS. 12 and 13 show one example of the conditioner cleaning device. A conditioner cleaning device 101 shown in FIGS. 12 and 13 is installed on the base 31*a* of the polishing apparatus 31 at a position within a movable area of the dresser 41*c* that is moved by the moving mechanism 24 (not shown in FIGS. 12 and 13) for the conditioner 41. The conditioner cleaning device 101 comprises a deposit scraper 102, a cleaning liquid supply mechanism 103, and a cleaning-liquid reclaiming mechanism 104 (cleaning-liquid reclaiming means). The conditioner cleaning device 101 further comprises a scraper driving mechanism made of a shaft body 105 having a center axis defined as a horizontal rotation axis R, and a driving device 106 for driving the shaft body 105 for rotation. The deposit scraper 102 and the cleaning-liquid supply mechanism 103 cooperatively construct a removing means for removing deposits on the dresser.

The shaft body 105 comprises a core body 111 having a symmetrical shape with respect to the center axis, and a scraper holding cylinder 112 for holding the deposit scraper 102 fitted over the core body 111. The core body 111 has at one end an abutment disk 111*a* against which the scraper holding cylinder 112 abuts when it is fitted in place, and has at the other end a threaded portion 111*b* projecting forward of the scraper holding cylinder 112 when it is fitted in place.

The scraper holding cylinder 112 is fixed to the core body 111 by a nut 113 such that the cylinder 112 is fitted over an outer periphery of the core body 111 and held abutted against the abutment disk 111*a*. The nut 113 is meshed with the threaded portion 111*b* and has an outer diameter smaller than that of the scraper holding cylinder 112.

The deposit scraper 102 is in the form of a brush or the like having a number of hairy filaments 114 that are planted on an outer peripheral surface of the scraper holding cylinder 112 and have lengths almost equal to each other. The hairy filaments 114 are made of, for example, a synthetic resin.

The cleaning liquid supply mechanism 103 comprises a cleaning liquid reservoir 116 and a cleaning liquid supply device 118 for supplying the cleaning liquid to the reservoir 116 through a supply pipe 117. Within the cleaning liquid reservoir 116, an overflow wall 119 having a lower height than an outer wall 116*a* of the reservoir 116 is provided adjacent to the outer wall 116*a* so as to form a doubled wall of the reservoir 116 in cooperation with the outer wall 116*a*. The supply pipe 117 has an opening 117*a* opened to the bottom of the reservoir 116 at a position of the reservoir 116 which is inward of the overflow wall 119.

The cleaning-liquid reclaiming mechanism 104 recovers the spent cleaning liquid, including the separated deposits, through an outflow pipe 120 having an opening 120*a* formed in a lower portion of the outer wall 116*a*. The cleaning-liquid reclaiming mechanism 104 includes, though not shown, a filter or the like for filtering the cleaning liquid, means for neutralizing acid or alkali contained in the slurry, etc.

The driving device 106 for driving the shaft body 105 for rotation is fixed to the outer wall 116*a* of the reservoir 116. A rotating shaft 121 projecting from the driving device 106 and rotating about its own axis is extended through the outer wall 116*a*. A rotation transmitting shaft 122 is fixed to the rotating shaft 121 such that center axes (rotation axes) of both the shafts are aligned with each other. Also, the rotation transmitting shaft 122 is fixed to the abutment disk 111*a* in coaxial relation so that the rotation of the rotating shaft 121 is transmitted to the shaft body 105. An end of the rotation transmitting shaft 122 opposite to the abutment disk 111*a* is inserted into the outer wall 116*a*. Between an outer peripheral surface of the rotation transmitting shaft 122 and the outer wall 116*a*, a packing 123 is disposed to seal off the interface between them while allowing the rotation transmitting shaft 122 to rotate. The driving device 106 is fixed at such a level that a top of the deposit scraper 102 provided on the outer periphery of the shaft body 105 is higher than an upper end of the overflow wall 119.

Further, to stabilize the rotation axis R of the shaft body 105, a support cylinder 124 having an outer diameter greater than that of the threaded portion 111*b* of the core body 111 is provided to project from the threaded portion 111*b* in coaxial relation to the core body 111. The support cylinder 124 is rotatably supported by a support 125 fixed to a bottom wall of the reservoir 116.

Figure 14:
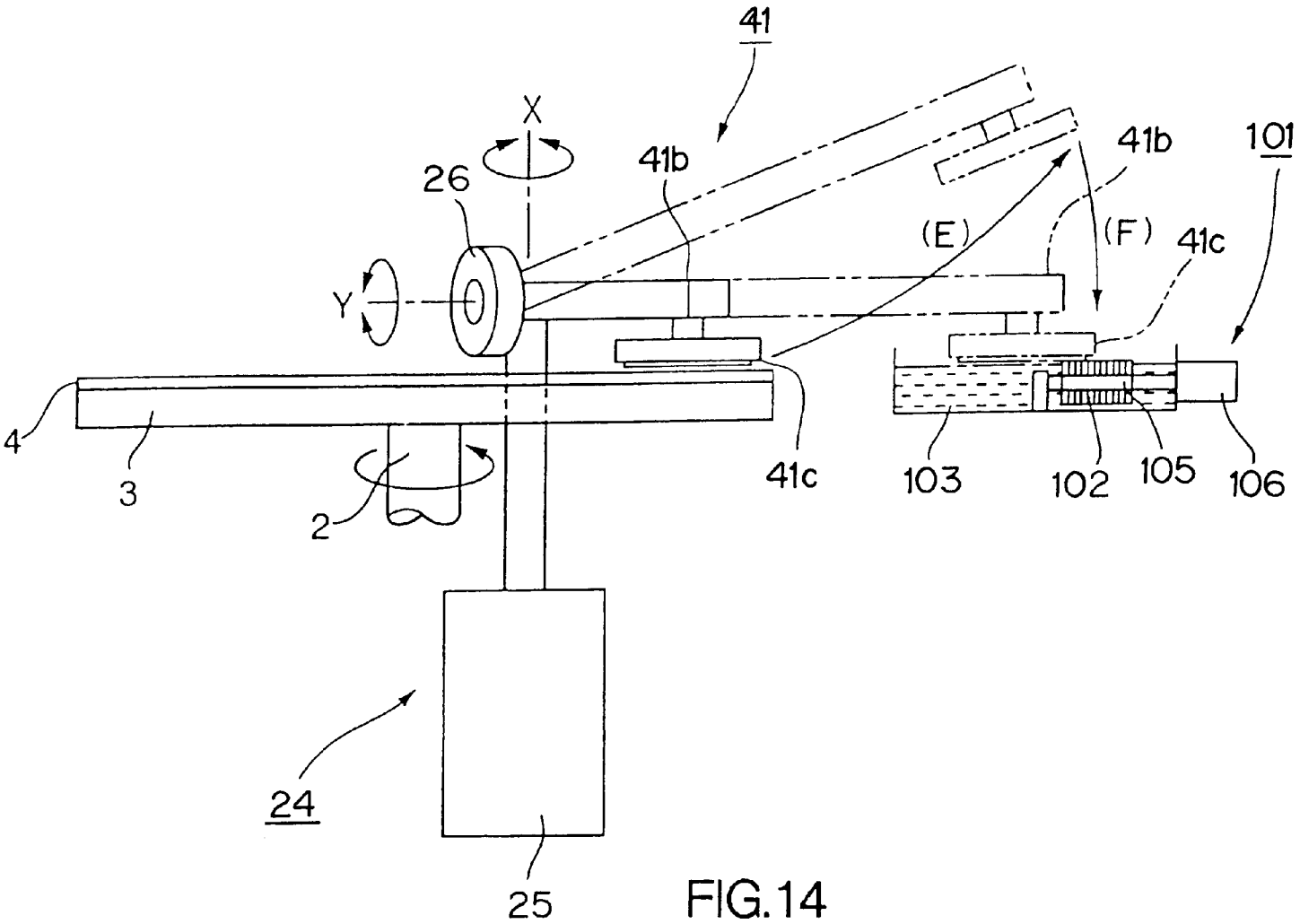
FIG. 14 is a schematic view showing one example of arrangement of the conditioner cleaning device used in the polishing apparatus according to the fourth embodiment of the present invention.

FIG. 14 shows one example of the conditioner cleaning device 101 having the above-described construction, in which the top of the deposit scraper 102 is positioned substantially at the same level as the surface of the polishing pad 4 so that the surface of a dressing portion 126 of the dresser 41*c* can be more easily brought into uniform contact with the deposit scraper 102.

For illustrating such an example in more detail, FIGS. 12 and 13 show a state where the dresser 41*c* held by the swing arm 41*b* is abutted against the deposit scraper 102. The dresser 41*c* substantially in the form of a disk has a ringshaped projection 128 formed in a predetermined width along a peripheral edge of a bottom surface 127 of the dresser 41*c*, and also has the dressing portion 126 formed in a fore end surface of the projection 128.

The conditioner cleaning device 101 shown in FIGS. 12, 13 and 14 operates as follows. First, the dresser 41*c* is moved by the moving mechanism 24 for the conditioner 41 in directions indicated by arrows E and then F in FIG. 14, for example, causing a part of the surface of the dressing portion 126 to come into contact with the deposit scraper 102. At this time, because the hairy resin filaments 114 forming the deposit scraper 102 are very thin filaments made of a soft synthetic resin and have flexibility, the hairy filaments 114 are deformed upon the dressing portion 126 contacting the deposit scraper 102, whereby all proximate areas of the dressing portion 126, including the surface of the dressing portion 126, the projection 128 projecting from the dresser 41*c*, and a peripheral edge portion of the bottom surface 127, come into contact with the deposit scraper 102.

Then, the shaft body 105 is rotated by the driving device 106 about the horizontal rotation axis R in a direction indicated by arrow G in FIG. 12, and the dresser 41*c* is rotated about its vertical center axis Z in a direction indicated by arrow H in FIG. 12. This operation causes the deposit scraper 102 to rotate in sliding contact with the surface of the dresser 41*c*, including the surface of the dressing portion 126 and the vicinity thereof, and to scrape off the deposits on the dresser 41*c*. At this time, the direction indicated by arrow G and the direction indicated by arrow H are set to oppose to each other in the contact area between the dresser 41*c* and the deposit scraper 102 so that the relative speed of the deposit scraper 102 with respect to the deposits is increased.

In the cleaning liquid supply mechanism 103, the cleaning liquid is reserved in the reservoir 116 through the supply pipe 117 under operation of the cleaning liquid supply device 118. The deposit scraper 102 is immersed in the cleaning liquid within the reservoir 116 such that distal ends of the hairy filaments 114 of the deposit scraper 102 located on the upper side are positioned above a surface level of the cleaning liquid, while the cleaning liquid permeates into and is held between the hairy filaments 114. With the shaft body 105 rotated in such a state, the hairy filaments 114 are moved upward and brought into contact with the dresser 41*c* while holding the cleaning liquid thereon. Simultaneously, the cleaning liquid held at the hairy filaments 114 flow toward the distal ends under the action of centrifugal force. The cleaning liquid is thus supplied to the contact area between the dresser 41*c* and the deposit scraper 102.

In this way, the cleaning liquid supplied from the cleaning liquid supply mechanism 103 is always present in the contact area between the surface of the dressing portion 126 and the deposit scraper 102, and the scraped-off deposits are dispersed into the cleaning liquid. As the cleaning liquid flows, the deposits dispersed into the cleaning liquid are moved away from the contact area. Consequently, the deposits are removed from the dresser 41*c*.

During the step of cleaning the surface of the dressing portion 126, the materials deposited on the surface of the dressing portion 126 are mixed in gradually increasing amount in the cleaning liquid reserved within the reservoir 116. However, the cleaning liquid is always supplied to the reservoir 116 by the cleaning liquid supply device 118, and when the liquid surface reaches the upper end of the overflow wall 119, the spent cleaning liquid including the deposits scraped off the dresser 116 overflows into a space defined between the overflow wall 119 and the outer wall 116*a* together with the deposits. As a result, the cleaning liquid is replaced by fresh liquid. The cleaning liquid including the deposits, which has overflowed beyond the overflow wall 119, is recovered and reclaimed by the cleaning-liquid reclaiming mechanism 104 through the outflow pipe 120. The cleaning liquid that has been reclaimed by the cleaning-liquid reclaiming mechanism 104 for recycling is sent to the cleaning liquid supply device 118 by a cleaning liquid transport mechanism (not shown).

With the conditioner cleaning device 101 shown in FIG. 12, therefore, the deposits adhering to the surface of the dressing portion 126 of the dresser 41*c* and the vicinity thereof can be scraped off by the deposit scraper 102 in the form of a brush or the like, and then removed by being washed out with the cleaning liquid.

In the embodiment described above, the deposit scraper 102 is arranged such that the top part of the deposit scraper 102 is positioned above the surface level of the cleaning liquid while the remainder of the deposit scraper 102 is immersed in the cleaning liquid. However, only a part of the deposit scraper 102 may be immersed in the cleaning liquid because it is essential that a sufficient amount of the cleaning liquid is held on the hairy filaments 114 and supplied to the contact area between the dressing portion 126 and the deposit scraper 102.

Conversely, the height of the overflow wall 119 may be increased to such an extent that the deposit scraper 102 is entirely immersed in the cleaning liquid. This enables the cleaning liquid to always reside around the hairy filaments 114. In other words, since the entire surface of the dressing portion 126 is immersed in the cleaning liquid at all times, it is possible to soften the deposits sufficiently, supply a larger amount of the cleaning liquid to the surroundings of the deposits that are dispersed into the cleaning liquid, and scrape off the deposits more effectively.

Where there is a restriction on a space available for the cleaning liquid supply mechanism 103, the size of the reservoir 116 may be reduced and the height of the outer wall 116*a* may be set equal to that of the overflow wall 119 to prevent the surface of the dressing portion 126 from interfering with the outer wall 116*a*.

Fifth Embodiment

Figure 15:
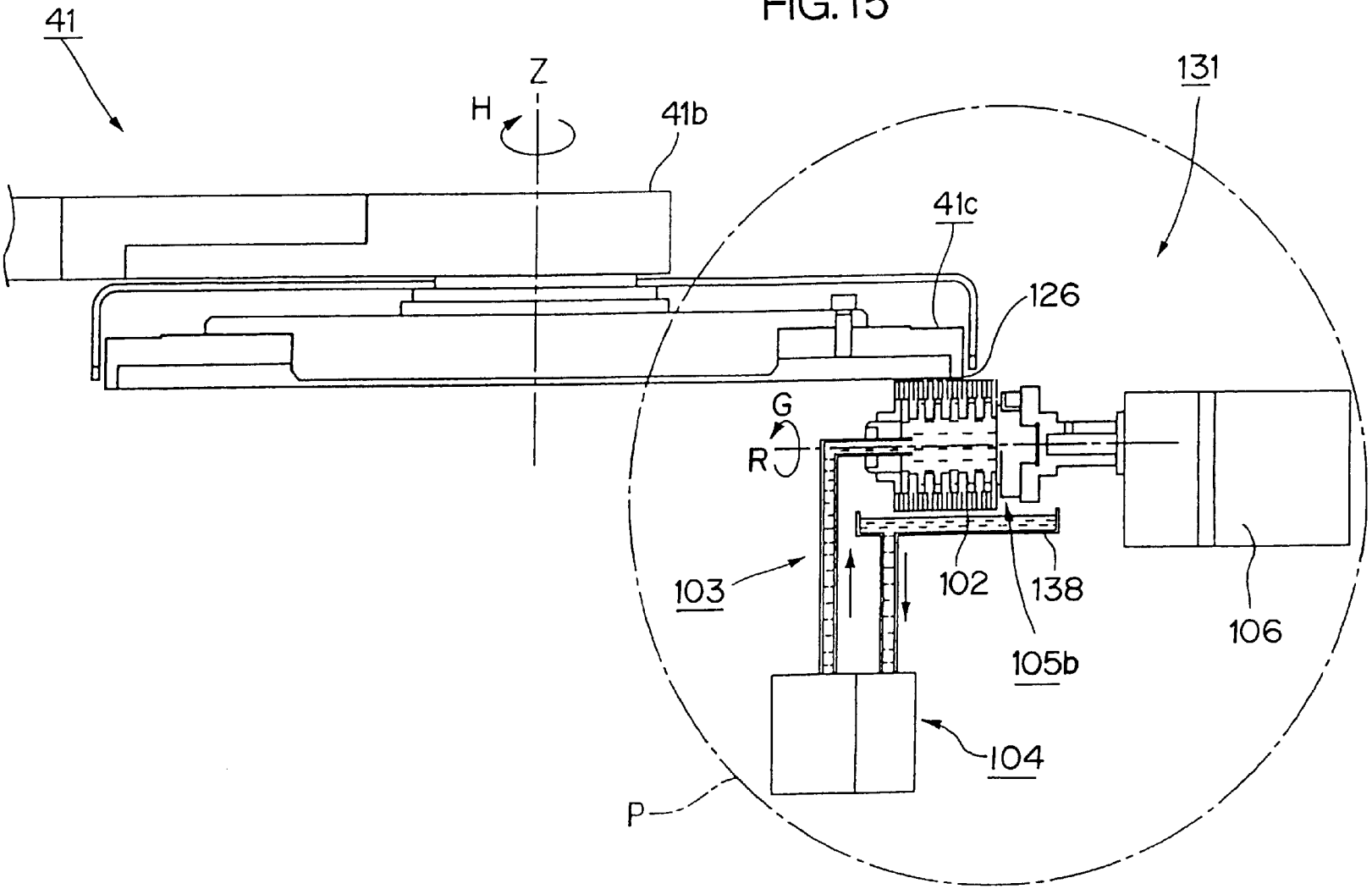
FIG. 15 is a sectional view of a conditioner cleaning device used in a polishing apparatus according to a fifth embodiment of the present invention.
Figure 16:
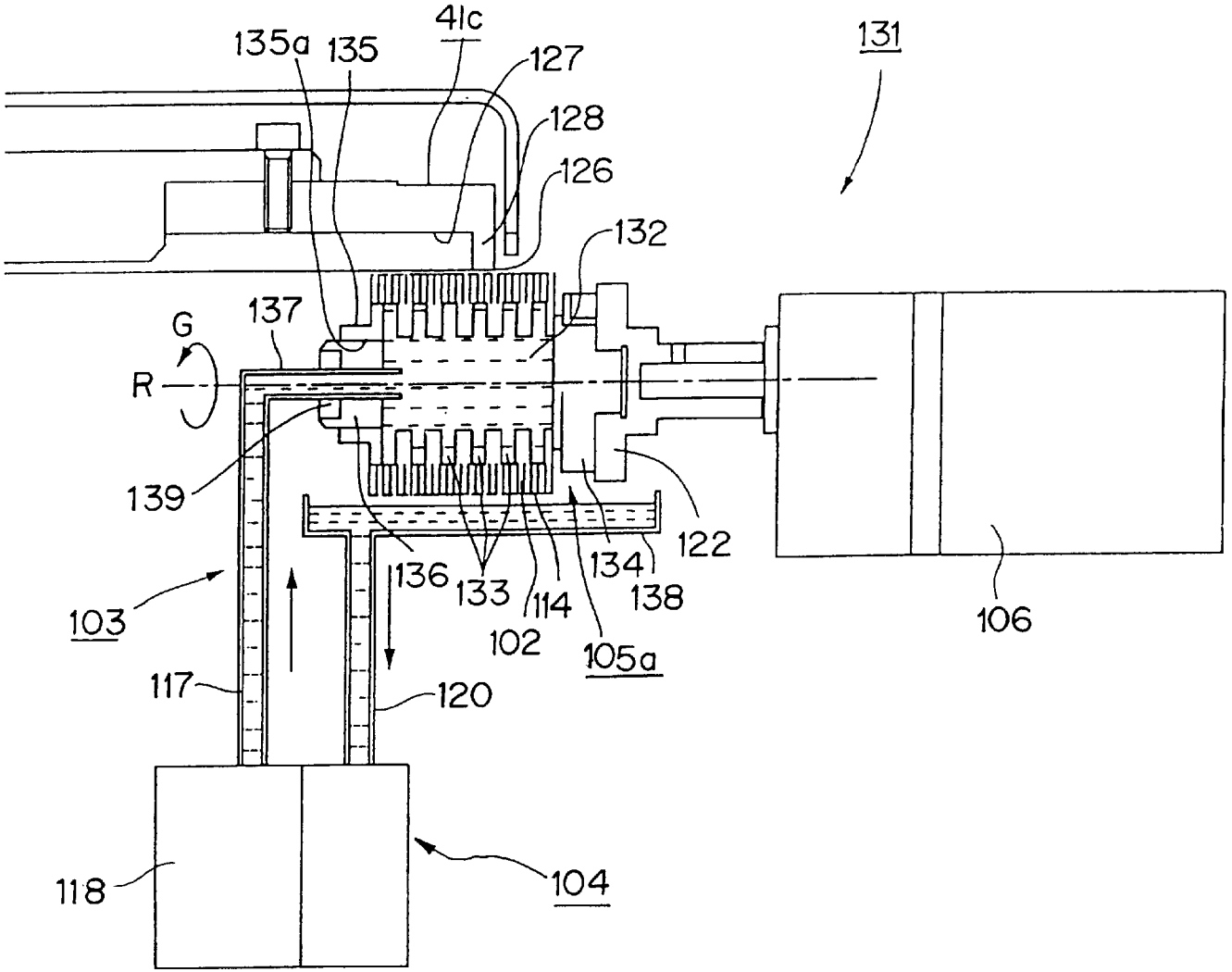
FIG. 16 is a sectional view showing a portion P in FIG. 15 in enlarged scale.

A fifth embodiment of the present invention will be described below with reference to the drawings. The same or equivalent components as or to those in the fourth embodiment described above are denoted by the same reference numerals and a description thereof is omitted here. A polishing apparatus of this fifth embodiment differs from that of the first embodiment in providing, in each polishing station of the polishing apparatus 31, a conditioner cleaning device 131 for cleaning the conditioner 41. The following description is therefore made primarily of the conditioner cleaning device 131. FIGS. 15 and 16 show one example of the conditioner cleaning device 131. The conditioner cleaning device 131 shown in FIGS. 15 and 16 is installed on the base 31*a* of the polishing apparatus 31 at a position within a movable area of the dresser 41*c* that is moved by the moving mechanism 24 (not shown in FIGS. 15 and 16) for the conditioner 41. The conditioner cleaning device 131 comprises a deposit scraper 102, a cleaning liquid supply mechanism 103, and a cleaning-liquid reclaiming mechanism 104 (cleaning-liquid reclaiming means). The conditioner cleaning device 131 further comprises a scraper driving mechanism made up of a shaft body 105*a* having a center axis defined as a horizontal rotation axis R, and a driving device 106 for driving the shaft body 105*a* for rotation. The deposit scraper 102 and the cleaning-liquid supply mechanism 103 together comprise a removing means for removing deposits on the dresser.

The shaft body 105*a* comprises a core body 134 having a hollow portion 132 formed therein and a plurality of fine holes 133 extending from the hollow portion 132 to open at an outer peripheral surface of the core body 134 for communication with the outside, and a lid 136 meshed with a threaded portion 135*a* in a liquid-tight manner which is formed in an inner peripheral surface of an open end portion 135 of the core body 134.

The deposit scraper 102 comprises a brush or the like having a number of hairy filaments 114 that are planted on the outer peripheral surface of the core body 134 and have lengths almost equal to each other. The hairy filaments 114 are made of, for example, a synthetic resin.

The cleaning liquid supply mechanism 103 comprises a cylindrical cleaning liquid conduit 137 inserted through the lid 136 for communication with the hollow portion 132 and having a center axis aligned with the axis of the core body 134, and a cleaning-liquid reclaiming mechanism 104 for supplying the cleaning liquid to the hollow portion 132 of the core body 134 through the cleaning liquid conduit 137 and a supply pipe 117, and for recovering the spent cleaning liquid, which includes the deposits separated from the dresser 41*c* and is collected in a cleaning liquid recovery pan 138, through an outflow pipe 120 for reclaiming the recovered cleaning liquid.

Between the lid 136, through which the cylindrical cleaning liquid conduit 137 is inserted, and the cylindrical cleaning liquid conduit 137, a packing 139 is disposed to seal off the interface between them while allowing the shaft member 105*a* to rotate.

Further, in the conditioner cleaning device 131 having the above-described construction, the top of the deposit scraper 102 is positioned substantially at the same level as the surface of the polishing pad 4 so that the surface of the dressing portion 126 can be more easily brought into uniform contact with the deposit scraper 102.

For illustrating one example of such an arrangement, FIG. 15 shows a state where the surface of the dressing portion 126 of the dresser 41*c* held by the swing arm 41*b* is abutted against the deposit scraper 102. Other components of the conditioner cleaning device 131 shown in FIGS. 15 and 16, which correspond to those shown in FIGS. 12 and 13, are denoted by the same reference numerals and a description thereof is omitted here.

As with the conditioner cleaning device 101 shown in FIGS. 12 and 13, the conditioner cleaning device 131 shown in FIGS. 15 and 16 operates as follows. The surface of the dressing portion 126 and the proximity thereof are brought into contact with the deposit scraper 102. Then, by rotating the shaft body 105*a* and the dresser 41*c*, the deposits are scraped off from the surface of the dressing portion 126 and the proximity thereof. At this time, the cleaning liquid supplied from the cleaning liquid supply mechanism 103 is always in the contact area between the surface of the dressing portion 126 and the deposit scraper 102, and the scraped-off deposits are dispersed into the cleaning liquid. As the cleaning liquid flows, the deposits dispersed into the cleaning liquid are moved away from the contact area. Consequently, the deposits are removed from the dresser 41*c*. The cleaning liquid supply mechanism 103 having a specific feature in the conditioner cleaning device 131 of this embodiment will be described below in more detail.

In the cleaning liquid supply mechanism 103, the cleaning liquid is supplied to the hollow portion 132 of the core body 134 and then introduced to the hairy filaments 114 forming the deposit scraper 102 through the plurality of fine holes 133 which are formed for communicating the hollow portion 132 with the outer peripheral surface of the core body 134. The cleaning liquid is thus supplied to the contact area between the surface of the dressing portion 126 and the deposit scraper 102.

The spent cleaning liquid including the deposits flows down from the deposit scraper 102 and is stored in the cleaning liquid recovery pan 138. Thereafter, the spent cleaning liquid is recovered by the cleaning-liquid reclaiming mechanism 104 through the outflow pipe 120 for reclaiming the recovered cleaning liquid.

With the conditioner cleaning device 131 shown in FIGS. 15 and 16, therefore, the deposits adhering to the surface of the dressing portion 126 of the dresser 41*c* and the vicinity thereof can be scraped off by the deposit scraper 102 in the form of a brush or the like, and then removed by being washed out with the cleaning liquid. Further, the cleaning liquid including no deposits is directly supplied to the surface of the dressing portion 126, from which the deposits are to be scraped off, and the spent cleaning liquid including the deposits flows out immediately after being supplied to the surface of the dressing portion 126. Accordingly, the scraped-off deposits can be effectively prevented from adhering to the dresser 41*c* again. The deposits can be thus surely removed from the dresser 41*c*.

While in the above-described embodiment the cleaning liquid including the deposits and flowing down from the deposit scraper 102 is recovered into the cleaning liquid recovery pan 138, the arrangement may be modified, as shown in FIG. 12, using the reservoir 116 and the overflow wall 119. In other words, the cleaning liquid is supplied through the supply pipe 117 in FIG. 12, whereas the cleaning liquid is supplied through the hollow portion 132 formed in the shaft body 105*a* in this embodiment. The deposits can be more effectively removed by positioning a supply inlet of the cleaning liquid closer to the dressing portion 126 and the deposit scraper 102. The reason is, as described above, that the cleaning liquid is directly supplied to the contact area between the dresser 41*c* and the deposit scraper 102, and therefore the deposits are less likely to adhere to the dresser 41*c* again.

Figure 17:
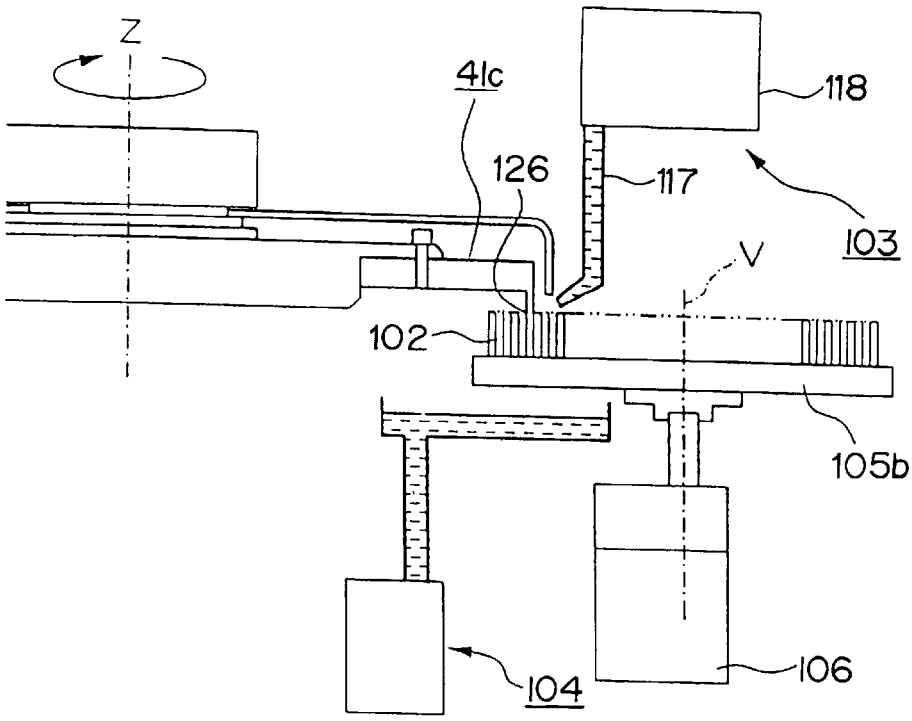
FIG. 17 is a sectional view showing another form of the polishing apparatus according to the fifth embodiment of the present invention.

In the embodiment described above, the deposit scraper 102 is provided on the outer peripheral surface of the shaft body 105 (or the shaft body 105*a*) substantially in the form of a cylinder. However, as shown in FIG. 17, the polishing apparatus may include a scraper driving mechanism made up of a disk-shaped shaft body 105*b* having a center axis defined as a vertical rotation axis R substantially parallel to the rotation axis Z of the dresser 41*c*, and a driving device 106 for driving the shaft body 105*b* for rotation. In this example, the cleaning liquid supply mechanism 103 is arranged so as to eject the cleaning liquid directly toward the contact area between the deposit scraper 102 and the dressing portion 126 through the supply pipe 117. As a matter of course, the cleaning liquid supply mechanism 103 may be constructed as shown in FIGS. 12 and 13.

Figure 18:
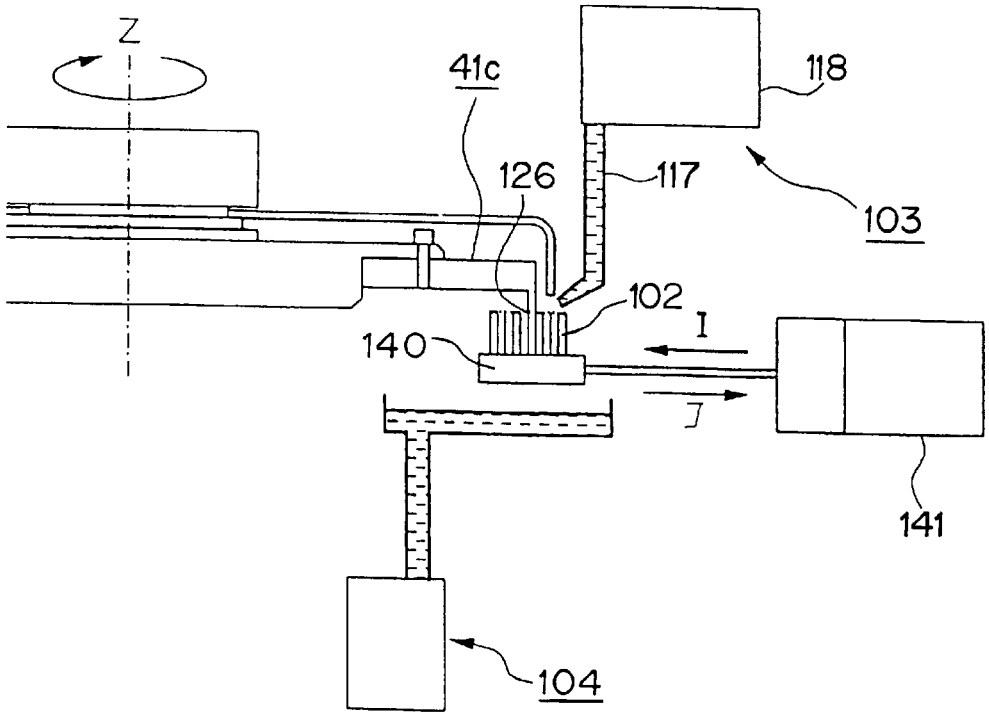
FIG. 18 is a sectional view showing still another form of the polishing apparatus according to the fifth embodiment of the present invention.

As another example having a simpler structure, the conditioner cleaning mechanism may be constructed as shown in FIG. 18. More specifically, the deposit scraper 102 may be provided on a rectangular plate 140 and moved in sliding contact with the surface of the dressing portion 126 by operating a driving device 141 (scraper driving mechanism)

to move the rectangular plate 140 reciprocally in directions indicated by arrows I and J in FIG. 18.

The sliding movement of the deposit scraper 102 is intended to efficiently remove the deposits from the surface of the dressing portion 126. As an alternative, therefore, the deposits may be removed by holding the deposit scraper 102 stationary and rotating the dresser 41*c* while the cleaning liquid is supplied to the contact area between the deposit scraper 102 and the dressing portion 126, thereby removing the deposits. It is hence:essential that the deposit scraper 102 be brought into contact with the dressing portion 126 and the vicinity thereof, to which deposits are adhering, and both or one of the dresser 41*c* and the deposit scraper 102 is moved to scrape off the deposits from the dresser 41*c*.

Additionally, the deposit scraper 102 can be made of any suitable material so long as it is easily permeated with the cleaning liquid and can retain the liquid, is so flexible to be able to come into contact with the surface of the dressing portion 126 and the vicinity thereof, and will not damage the surface of the dresser 41*c*. Thus, the material of the deposit scraper 102 can be selected from a variety of materials. A cellular (spongy) member, for example, may be used instead of the hairy filaments 114.

While several examples of the deposit removing means made up of the deposit scraper 102 and the cleaning-liquid supply mechanism 103 have been described above, the deposit removing means may be implemented in any of other suitable structures.

Figure 19:
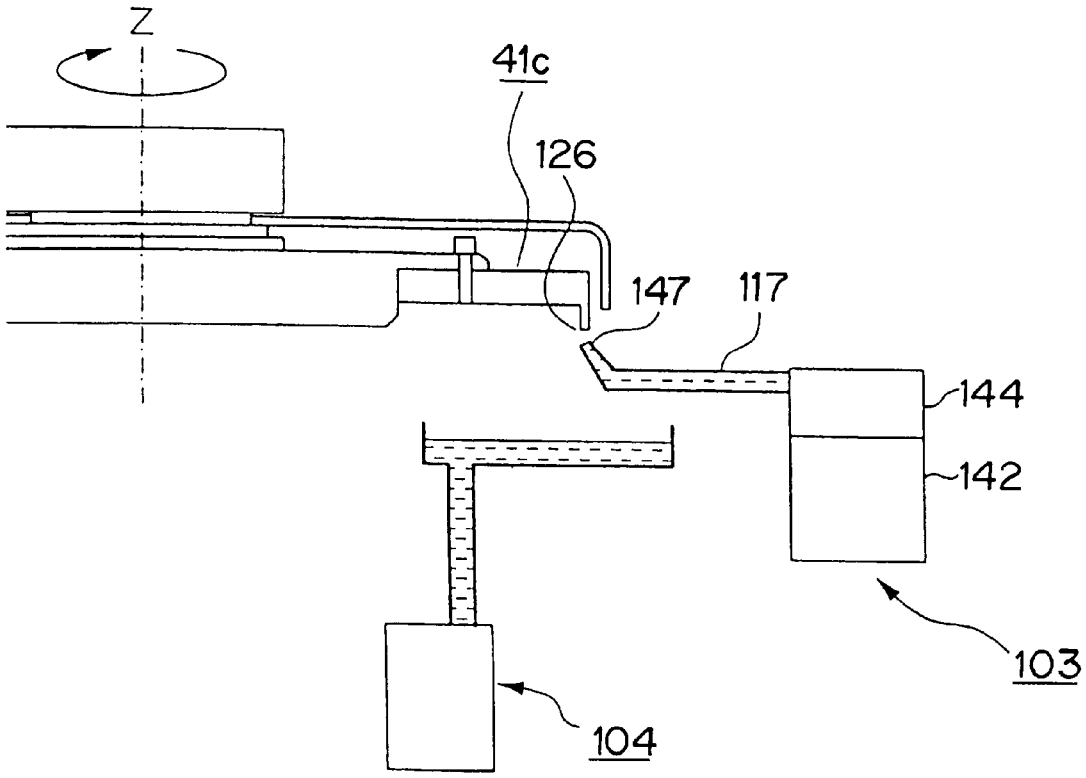
FIG. 19 is a sectional view showing still another form of the polishing apparatus according to the fifth embodiment of the present invention.

As shown in FIG. 19, by way of example, the deposit removing means may be arranged such that a high-pressure cleaning liquid supply mechanism 142 for delivering the cleaning liquid under high pressure to the supply pipe 117 is provided as the cleaning liquid supply mechanism 103, and a nozzle 143 is attached to a fore end of the supply pipe 117 for vigorously spraying the cleaning liquid toward the surface of the dresser 41*c*. This arrangement enables the deposits to be washed out of the dresser 41*c* together with the cleaning liquid sprayed under high pressure.

Also, in the arrangement including the high-pressure cleaning liquid supply mechanism 142 to spray the cleaning liquid, an ultrasonic wave applying mechanism 144 may be additionally provided for applying ultrasonic oscillations to the cleaning liquid to be sprayed. Alternatively, the deposits may be removed from the dresser 41*c* by pooling the cleaning liquid in a reservoir, immersing the dressing portion 126 and the vicinity thereof in the cleaning liquid, and applying ultrasonic oscillations to the cleaning liquid.

While the above embodiment has been described as employing, by way of example, the conditioner shown in FIG. 1, the conditioner cleaning device may also be employed for any other conditioner. Stated otherwise, the conditioner cleaning device 101 shown in FIGS. 12 and 13 or the conditioner cleaning device 131 shown in FIGS. 15 and 16 can be similarly provided within a movable area of a dresser in any other conditioner for removing deposits from the dresser.

Sixth Embodiment

Figure 20:
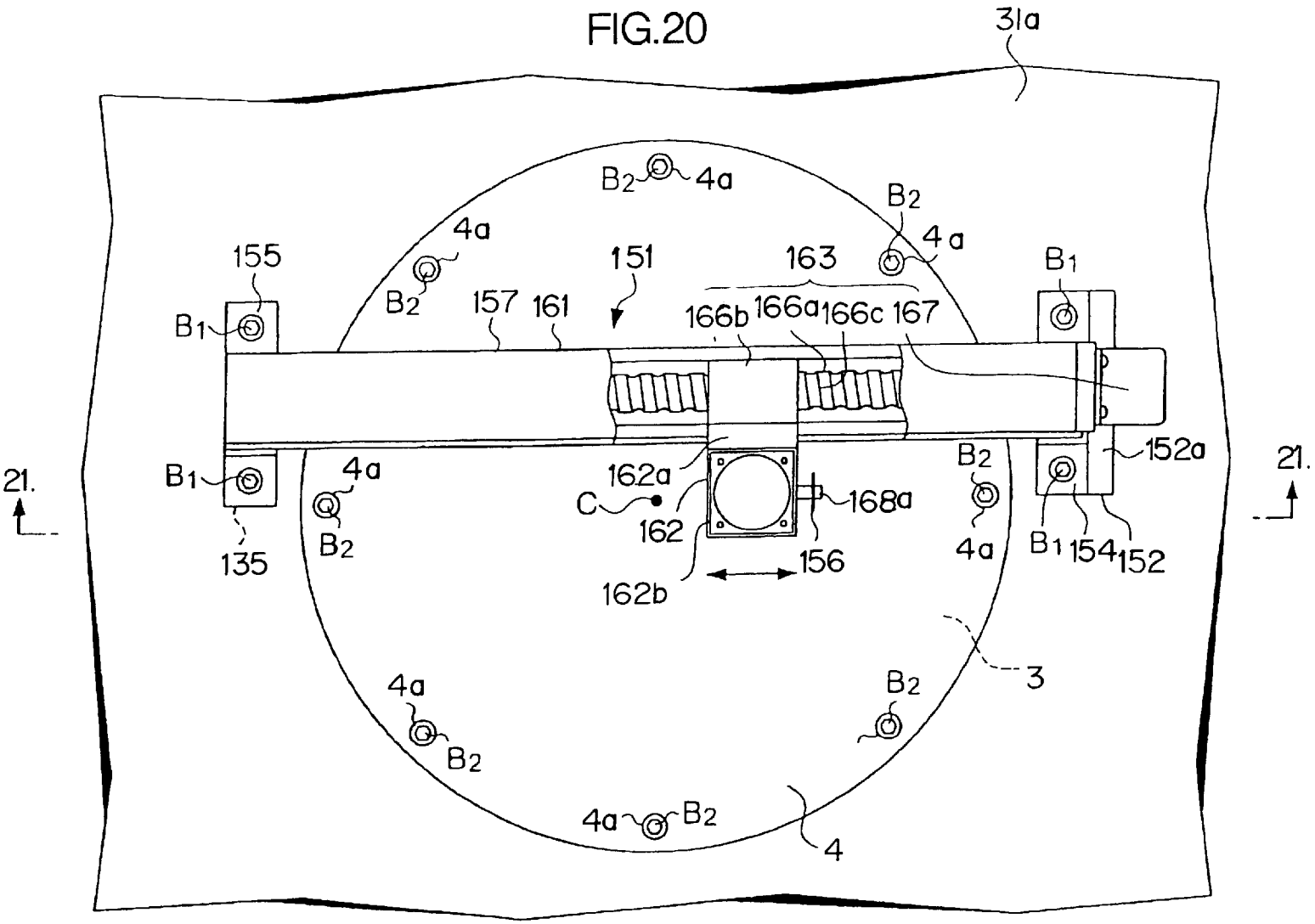
FIG. 20 is a plan view, partly broken away, showing a construction of a polishing apparatus according to a sixth embodiment of the present invention.
Figure 21:
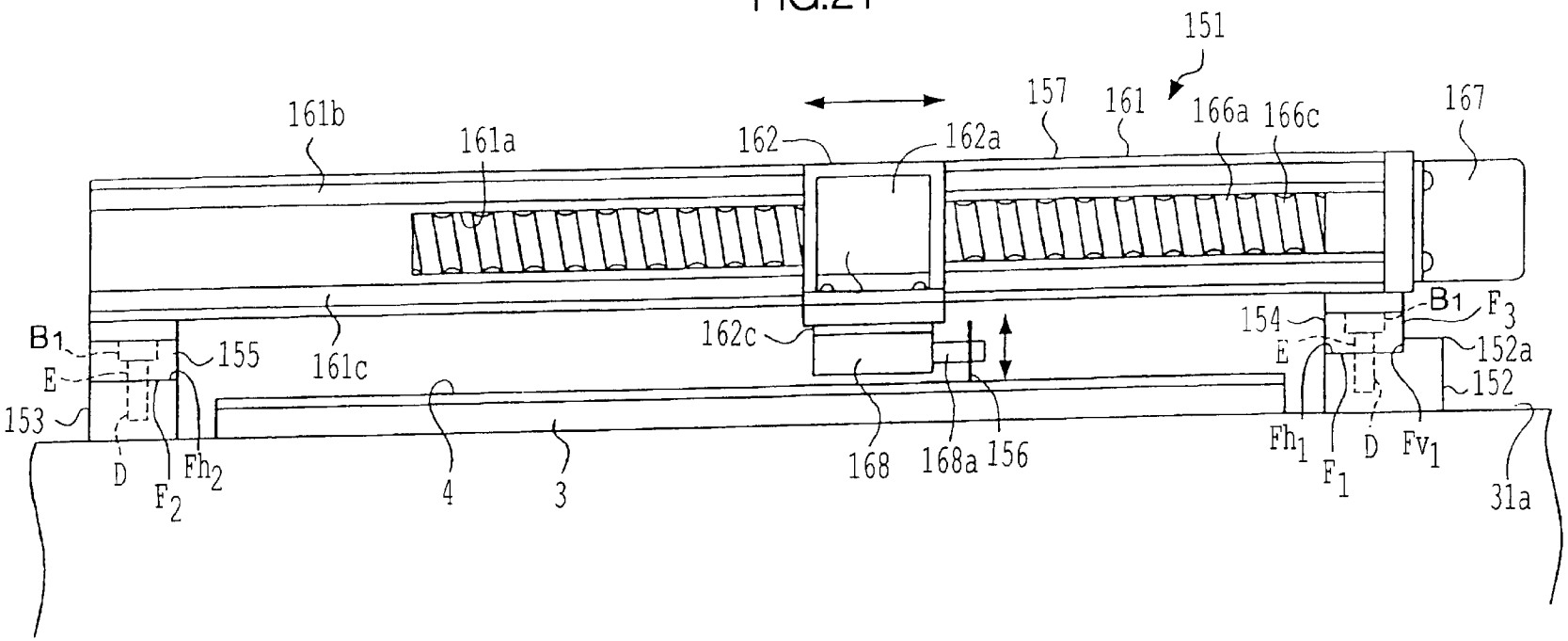
FIG. 21 is an enlarged sectional view taken along line A—A in FIG. 20, showing the construction of the polishing apparatus according to the sixth embodiment of the present invention.

A sixth embodiment of the present invention will be described below with reference to the drawings. The same or equivalent components as or to those in the related art or the first embodiment described above are denoted by the same reference numerals and a description thereof is omitted here. A polishing apparatus of this sixth embodiment differs from that of the first embodiment in providing a grooving device 151, described below, in each polishing station of the polishing apparatus 31. The following description is therefore made primarily of the grooving device 151. FIGS. 20 to 22 show one example of the grooving device 151. The grooving device 151 shown in FIGS. 20 and 21 is installed on the base 31*a* of the polishing apparatus 31. The polishing apparatus of this embodiment employs, as the polishing pad 4, a polishing pad with a thickness T of not less than 5 mm.

Figure 22A:
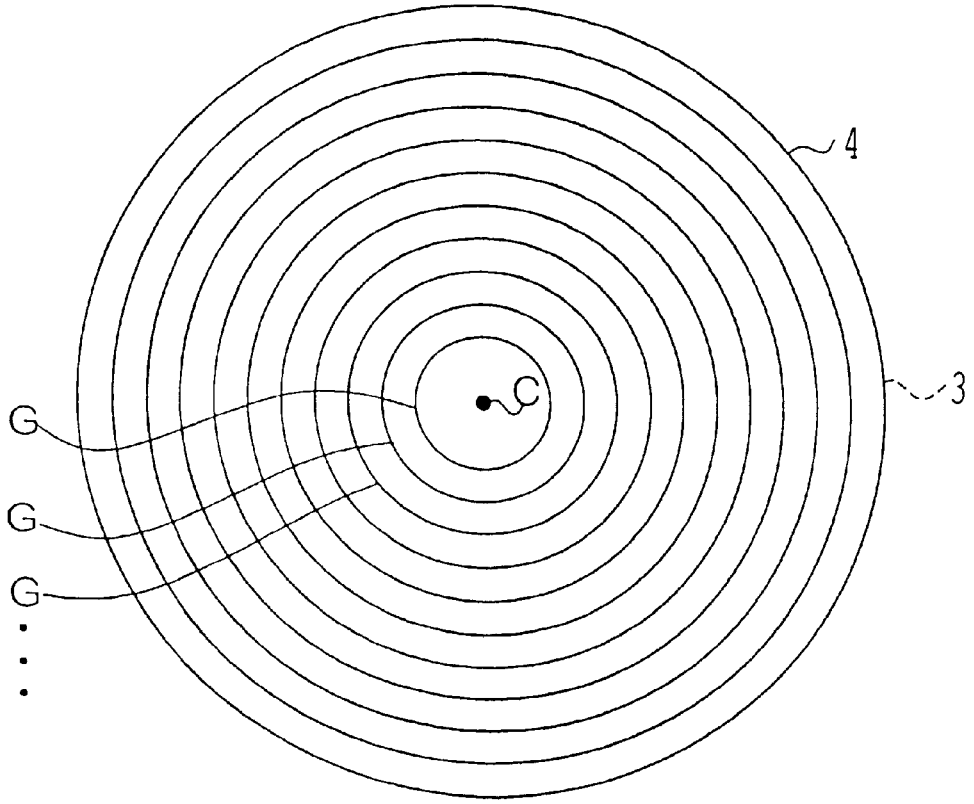
FIG. 22A is a plan view showing in a conceptual manner a shape of a polishing pad used in the polishing apparatus according to the sixth embodiment of the present invention.
Figure 22B:
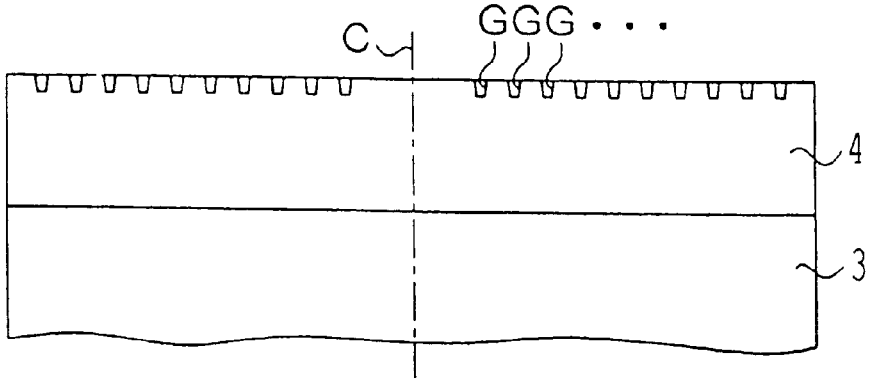
FIG. 22B is a partial enlarged sectional view showing in a conceptual manner the shape of the polishing pad used in the polishing apparatus according to the sixth embodiment of the present invention.

FIG. 20 is a plan view, partly broken away, showing a construction of the grooving device 151 used in the polishing apparatus of this embodiment, and a structure for mounting the grooving device 151 onto an upper surface of the base 31a. FIG. 21 is an enlarged sectional view taken along line A—A in FIG. 20, and FIGS. 22A and 22B each show a shape of the polishing pad in a conceptual manner; i.e., FIG. 22A is a plan view and FIG. 22B is a partial front enlarged sectional view.

As shown in FIGS. 20 and 21, first and second mount stands 152, 153 are fixedly provided on the upper surface of the base 31*a* at positions on both sides of the platen 3. The grooving device 151 is detachably attached to the first and second mount stands 152, 153 so as to lie between both the stands.

The first and second mount stands 152, 153 are each substantially in the form of a rectangular parallelepiped and arranged to extend substantially perpendicularly to the longitudinal direction of the grooving device 151.

As shown in FIG. 21, a horizontal reference surface Fh1 is formed as a mount reference surface in one part of an upper surface of the first mount stand 152, which is substantially horizontal and positioned on the side nearer to the second mount stand 153. Also, a projected step 152*a* is formed in the other part of the upper surface of the first mount stand 152 to extend in the longitudinal direction thereof, which is positioned on the side farther away from the second mount stand 153. Then, a vertical reference surface Fv1 is defined by a surface of the projected step 152*a* extended substantially vertical and facing toward the second mount stand 153.

A substantially horizontal upper surface of the second mount stand 153 serves as a horizontal reference surface Fh2. The horizontal reference surfaces Fh1 and Fh2 are positioned to lie on the same horizontal plane, and they each have bolt holes D formed near longitudinal opposite ends thereof. First and second leg portions 154, 155 of the grooving device 151 are fixed respectively to the first and second mount stands 152, 153 by bolts B1 fastened into the bolt holes D.

Further, as shown in FIGS. 20 and 21, the grooving device 151 comprises a cutter 156 serving as a cutting edge, and a slide way 157 (cutting-edge moving device) for moving the cutter 156 on the rotating platen 3 to follow a straight line passing the center C of rotation of the platen 3 to form grooves in a pattern of closed curves or a spiral groove in the polishing pad 4.

The slide way 157 has a frame 161 that is substantially in the form of a hollow rectangular prism and has opposite ends in the longitudinal direction attached respectively to the first and second mount stands 152, 153 through the first and second leg portions 154, 155. The frame 161 mounts thereon a tool post 162 to which the cutter 156 is attached, the tool post 162 being movable along one side of the frame 161 in the longitudinal direction together with the cutter 156, and a driving device 163 for moving the tool post 162 along the frame 161 in synchronous relation to the rotation of the platen 3. The frame 161 is arranged at a position spaced a predetermined distance from the center C of rotation of the platen 3 so that the cutter 156 attached to the tool post 162 movable along one side of the frame 161 may be moved on the straight line passing the center C of rotation of the platen 3.

The first and second leg portions 154, 155 are each substantially in the form of a rectangular parallelepiped and provided at longitudinal opposite ends of the frame 161 on the underside thereof with longitudinal opposite ends of each leg portion projecting outward from both lateral surfaces of the frame 161. The first leg portion 154 has a lower surface defined as a mount flat surface F1, and the second leg portion 155 has a lower surface defined as a mount flat surface F2, these mount flat surfaces F1, F2 being positioned to lie on the same flat plane. The frame 161 is positioned to be substantially horizontal on the platen 3 by placing the mount flat surfaces F1, F2 respectively in abutment against the horizontal reference surfaces Fh1, Fh2 of the first and second mount stands 152, 153.

Further, the first leg portion 154 has a mount flat surface F3 that is defined by its lateral surface facing away from the second leg portion 155 and is extended substantially perpendicularly to the longitudinal direction of the frame 161 and also to the mount flat surface F1. By placing the mount flat surface F3 to come into plane contact with the vertical reference surface Fv1 of the first mount stand 152, the frame 161 is positioned in proper orientation. Thus, the first leg portion 154 is properly positioned with respect to the first mount stand 152 using the two reference surfaces.

Bolt insertion holes E are formed in opposite end portions of each of the first and second leg portions 154, 155 in the longitudinal direction to penetrate from an upper surface to a lower surface of the leg portion. The first and second leg portions 154, 155 are detachably attached respectively to the first and second mount stands 152, 153 by inserting the bolts B1 through the bolt insertion holes E and fastening them into the bolt holes D formed in the first and second mount stands 152, 153.

The first mount stand 152 and the first leg portion 154 may be more precisely positioned relative to each other by, in addition to the bolt holes D and the bolt insertion holes E, forming another fitting hole in the upper surface of the first mount stand 152, forming a through hole in the first leg portion 154 penetrating from the upper surface to the lower surface thereof, and driving a knock pin into the another fitting hole via the through hole.

Within the frame 161, there is disposed a ball screw mechanism 166 comprising a screw shaft 166*a* extending in the longitudinal direction of the frame 161 and supported at its opposite ends by the frame 161 in a rotatable manner, and a nut member 166*b* held in mesh through steel balls with a screw groove 166*c* formed in an outer peripheral surface of the screw shaft 166*a*. Incidentally, the nut member 166*b* is supported by an inner surface of the frame 161 to be restricted from rotating together with the screw shaft 166*a*.

Also, a screw-shaft driving motor 167 having a rotating shaft coupled to the screw shaft 166*a* is provided on an end surface of the frame 161 on the same side as the first leg portion 154. By rotating the screw shaft 166*a* with the screw-shaft driving motor 167, the nut member 166*b* is moved in the axial direction of the screw shaft 166*a*.

The ball screw mechanism 166 and the screw-shaft driving motor 167 constitute the driving device 163, and the operation of the screw-shaft driving motor 167 is controlled by a control unit (not shown). The control of the screw-shaft driving motor 167 by the control unit may be effected manually or automatically in synchronous relation to the rotation of the platen 3.

Moreover, the frame 161 has an elongate hole 161*a* formed in its lateral surface facing toward the center C of rotation of the platen 3, and the tool post 162 is coupled to the nut member 166*b* of the ball screw mechanism 166 through the elongate hole 161*a*. Guide rails 161*b*, 161*c* are provided on the lateral surface of the frame 161 above and below the elongate hole 161*a* to extend in the longitudinal direction of the elongate hole 161*a* for guiding the tool post 162.

The tool post 162 comprises a base portion 162*a* coupled to the nut member 166*b* of the ball screw mechanism 166 and having upper and lower ends held in engagement with the guide rails 161*b*, 161*c*, and a cutter attachment portion 162*b* projecting from the lower end of the base portion 162*a* laterally of the frame 161. A cutter driving motor 168 is provided on the underside of the cutter attachment portion 162*b* through a cutter lifting device 162*c*, and the cutter 156 substantially in the form of a disk is attached to a drive shaft 168*a* of the motor 168 in an almost orthogonal relation.

The operation of the cutter lifting device 162*c* is controlled by the control unit (not shown), and the cutter 156 is moved up and down along with the cutter driving motor 168 upon the operation of the cutter lifting device 162*c*. The cutter lifting device 162*c* is constructed by an actuator driven to extend and retract in the vertical direction by utilizing hydraulic or pneumatic pressure, for example.

The cutter driving motor 168 is mounted with the drive shaft 168*a* extending parallel to the longitudinal direction of the frame 161, and therefore the cutter 156 is rotated in a plane that is substantially perpendicular to the surface of the polishing pad 4 on the platen 3 and also to the moving direction of the tool post 162.

The polishing pad 4 is formed of, for example, a polyurethane-made pad that is substantially in the form of a disk having a thickness of about 15 mm. Also, the polishing pad 4 is made of polyurethane not foamed or slightly foamed with a foaming rate of not more than 20% so that a desired degree of hardness is ensured.

Additionally, as shown in FIG. 22A, a plurality of concentric grooves G are formed beforehand on the surface of the polishing pad 4 about the center C of rotation thereof (or of the platen 3). As shown in FIG. 22B, by way of example, those grooves G are each trapezoidal in cross-section with the opening side being greater in width than the bottom side. It is preferable that a proportion of the areas of all the grooves G with respect to the total surface area of the polishing pad 4 be not less than 20%.

Further, as shown in FIG. 20, the polishing pad 4 has bolt holes 4*a* formed in its outer peripheral edge that is not used for polishing the wafers W, and is fixed to the upper surface of the platen 3 by fastening bolts B2 through the bolt holes 4*a*. The bolts B2 are fastened in such a way that the head of each bolt is positioned in the bolt hole 4*a* at a predetermined depth from the surface of the polishing pad 4. This arrangement prevents the bolt heads from interfering with the dresser and the other components even when the thickness of the polishing pad 4 is reduced with the repeated conditioning.

In the polishing apparatus having the above-described construction, the grooves G in the surface of the polishing pad 4 are cut by the grooving device 151 again as follows.

A description is started from a step of mounting the grooving device 151 on the base 31*a* because the grooving device 151 is removed from the base 31*a* during the polishing process of the wafers W.

First, in the polishing apparatus, the arm (upper attachment plate) 34 is raised to form a space to install the grooving device 151 between the platen 3 and the polishing heads (wafer holding heads) 5.

Then, the grooving device 151 is mounted onto the base 31*a* by positioning and fixing the first and second leg portions 154, 155 of the grooving device 151 respectively to the first and second mount stands 152, 153 provided on the base 31*a* of the polishing apparatus.

The step of positioning and fixing the first and second leg portions 154, 155 to the first and second mount stands 152, 153 is carried out as described below.

The mount flat surface F1 defined by the lower surface of the first leg portion 154 is brought into plane contact with the horizontal reference surface Fh1 formed in the upper surface of the first mount stand 152, and the mount flat surface F2 defined by the lower surface of the second leg portion 155 is brought into plane contact with the horizontal reference surface Fh2 formed in the upper surface of the second mount stand 153. The frame 161 of the grooving device 151 is thereby supported above the platen 3 to extend substantially horizontally in the longitudinal direction thereof. Then, the mount flat surface F3 of the first leg portion 154 is brought into plane contact with the vertical reference surface Fv1 of the first mount stand 152. The frame 161 is thereby positioned in proper orientation so that the cutter 156 held by one side of the frame 161 through the tool post 162 is moved on the straight line passing the center C of rotation of the platen 3.

In the properly positioned state of the frame 61, by inserting the bolts B1 through the bolt insertion holes E formed in the first and second leg portions 154, 155 and then fastening the bolts B1 into the bolt holes D formed in the horizontal reference surfaces Fh1, Fh2 of the first and second mount stands 152, 153, the first and second leg portions 154, 155 are fixed to the first and second mount stands 152, 153, respectively.

After fixing the grooving device 151 in such a way, the tool post 162 is moved along the frame 161 by the driving device 163, and the cutter 156 attached to the tool post 162 is positioned to lie above one of the grooves G of the polishing pad 4 on the platen 3. That one groove of the polishing pad 4 is then cut again by rotating the platen 3 and lowering the cutter 156 to come into contact with the polishing pad 4 by the cutter lifting device 162*c* while the cutter 156 is rotated by the cutter driving motor 168.

The tool post 162 is moved by the driving device 163 as follows.

When the screw shaft 166*a* of the ball screw mechanism 166 is rotated by the screw-shaft driving motor 167, the nut member 166*b* is moved in the longitudinal direction of the screw shaft 166*a* because it is restricted by the frame 161 from rotating together with the screw shaft 166*a*. As a result, the tool post 162 mounted to the nut member 166*b* is also moved in the longitudinal direction of the frame 161.

After moving the tool post 162 in such a way, the cutter 156 is lowered along with the cutter driving motor 168 by the cutter lifting device 162*c* to such an extent that the cutter 156 is driven into the surface of the polishing pad 4 by a predetermined depth of about 0.5 mm. Since the polishing pad 4 is rotated about the center C of rotation thereof in the above state, the groove G of the polishing pad 4 is cut by the cutter 156 so as to have a depth of about 0.5 mm again. At this time, the sectional shape of the groove G is also reformed into the original one, and hence a proportion of the area of the groove G with respect to the total surface area of the polishing pad 4 is restored to the predetermined value.

After cutting one groove G again in such a way, the cutter 156 is raised by the cutter lifting device 162*c* to move away from the surface of the polishing pad 4. The tool post 162 is then moved a predetermined distance toward the inner or outer peripheral side of the polishing pad 4, causing the cutter 156 to lie above another one of the grooves G. Subsequently, re-cutting of the groove G is performed in the same manner as described above.

By repeating the above operation for each groove G of the polishing pad 4, all the grooves G of the polishing pad 4 are eventually cut again.

After completion of the grooving of the polishing pad 4, the polishing pad 4 is subjected to conditioning by using the dresser (not shown) to remove burrs or cuttings caused on the surface of the polishing pad 4 during the grooving process. After thus conditioning the surface state of the polishing pad 4, the wafer polishing work is resumed.

The surface level of the polishing pad 4 is gradually lowered because the polishing pad 4 is chipped off in the conditioning step. Depending on such a lowering of the surface level of the polishing pad 4, the height of the cutter 156 is adjusted by the cutter lifting device 162*c* so that the surface of the polishing pad 4 is cut by the cutter 156 into the predetermined depth.

On the other hand, where the groove G of the polishing pad 4 is formed in a spiral shape about the center C of rotation of the platen 3, the groove G is cut again as follows.

First, the tool post 162 is moved to position the cutter 156 to lie above an innermost or outermost peripheral portion of the groove G of the polishing pad 4. Then, by turning the platen 3, the end of the groove G on the innermost or outermost peripheral side is positioned to lie just below the cutter 156.

Subsequently, while keeping the cutter 156 driven into the surface of the polishing pad 4 by a predetermined depth, the platen 3 is rotated and the tool post 162 is moved to travel the cutter 156 on the straight line passing the center C of rotation of the platen 3. At this time, the moving speed of the tool post 162 and the rotating speed of the platen 3 are adjusted by the control unit (not shown) so that the cutter 156 precisely traces the groove G.

After completion of the re-cutting of the groove G, as with the above-described case, the polishing pad 4 is subjected to conditioning and the wafer polishing work is resumed subsequent to the conditioning of the surface state of the polishing pad 4.

By using the polishing apparatus of this embodiment, the groove(s) G can also be newly cut in the polishing pad 4, which has no grooves already formed therein, in accordance with the same steps as described above. In this case, the groove formed in the polishing pad 4 has the same shape as that formed by the re-grooving process described above, and the groove-to-groove spacing, etc. can be optionally set.

According to the polishing apparatus thus constructed, a groove can be cut in the polishing pad 4 in a state where it is held on the polishing apparatus. Therefore, even when the groove G in the polishing pad 4 has become shallow with the repeated conditioning, the groove G can be cut again to have a predetermined depth, thus resulting in a longer useful life of the polishing pad 4.

Also, the depth of the groove G can be maintained in a proper range by cutting the groove G again in the polishing pad 4 at the time when the depth of the groove G has reduced to a certain value.

Because the groove G formed in the polishing pad 4 is trapezoidal in cross-section with the opening side being greater in width than the bottom side, the groove width is gradually narrowed as the groove becomes shallower. By cutting the groove again at the proper timing, however, the groove width can also be maintained in a proper range.

Further, the groove G can be effectively formed in the polishing pad 4 by the grooving device 151 with a simple construction. In addition, the groove G can be formed in a pattern of any suitable closed curves, including circles and ellipses, or a spiral groove depending on the polishing conditions required.

When polishing the wafers W, the grooving device 151 can be detached from the base 31*a* for effective use of a space above the polishing pad 4.

Since the polishing pad 4 used in this embodiment has the thickness T of 15 mm, the number of times by which the polishing pad can be grooved by the grooving device 151 is increased in comparison with the case of employing an ordinary polishing pad with a thickness of about 2 to 4 mm. As a result, the useful life of the polishing pad can be prolonged.

Further, it is possible to more effectively employ the polishing pad. Specifically, assuming that an ordinary polishing pad has an initial thickness of, e.g., 4 mm and is not subjected to the grooving process by the grooving device 151, the ordinary polishing pad is practically used in effective thickness just corresponding to the groove depth (0.5 mm), i.e., 12.5% of the initial thickness, at maximum. By contrast, when the polishing pad 4 in this embodiment is repeatedly subjected to the grooving process and employed until the remaining thickness reaches 5 mm, for example, the polishing pad 4 can be practically used in effective thickness corresponding to 75% of the initial thickness (15 mm).

Moreover, since the strength of the polishing pad 4 is enhanced with an increase in pad thickness, a proportion of the area of the groove(s) G with respect to the total surface area of the polishing pad 4 can be increased up to 20%, for example. With such a high proportion of the groove area, polishing chips and other foreign matter, which may cause scratches on the wafer surfaces, can be quickly taken into the groove G and the contact area between the polishing pad 4 and the wafer W can be reduced.

A reduction in the contact area between the polishing pad 4 and the wafer W enables pressure to be concentrated in portions of the polishing pad 4 contacting the wafer W even when the pressure applied to press the wafer W against the polishing pad 4 is reduced, for example, to suppress deformation of the wafer W. It is hence possible to ensure the polishing pressure and to alleviate a lowering of the working efficiency.

Additionally, when the polishing pad 4 is made of, for example, a material not foamed or slightly foamed with a foaming rate of not more than 20%, uniformity of the polishing pad 4 in the direction of thickness thereof can be improved and a practically usable area of the polishing pad 4 can be increased. Further, since the hardness of the polishing pad 4 is also increased, a sinking of the wafer W into the polishing pad 4 during the polishing step is reduced, and therefore the wafer W is less likely to cause edge droop. Here, the contact state between the surface of the polishing pad 4 and the wafer W can be controlled by adjusting the depth of the groove G and hence adjusting an amount by which the surface of the polishing pad 4 is elastically deformed.

The embodiment described above employs, as the driving device 163 for the cutting-edge moving device, the ball screw mechanism 166 made up of the screw shaft 166*a* and the nut member 166*b* which are both accommodated in the frame 161, and the screw-shaft driving motor 167 for driving the screw shaft 166*a* to rotate about its own axis. However, the driving device 163 is not limited to such an arrangement, but may be constructed, by way of example, as follows. A rack is provided to extend in the longitudinal direction of the frame 161, whereas a pinion gear meshing with the rack and a motor for rotating the pinion gear are provided on the tool post 162. These rack, pinion gear and motor constitute the driving device 163. By energizing the motor to rotate the pinion gear meshing with the rack, the tool post 162 is moved along the frame 161.

Thus, the cutting-edge moving device may be of any suitable structure so long as it is able to control the position of the cutter serving as a cutting edge.

Also, in the above embodiment, the grooving device 151 is detachably attached to the base 31*a* (polishing apparatus body). However, the grooving device 151 is not limited to such an arrangement, but may be constructed, by way of example, as follows. One end of the grooving device 151 is attached to the base 31*a* through a rotary shaft, and the other end is turned substantially horizontally about the rotary shaft, allowing the grooving device 151 to move onto or away from the polishing pad. As an alternative, the grooving device 151 may be moved onto or away from the polishing pad with such an arrangement that rollers are provided on the leg portions of the grooving device 151, rails are laid on the base 31*a* for guiding the rollers, and the grooving device 151 is moved along the rails.

Further, the above embodiment employs, as a cutting edge, the disk-shaped cutter 156 driven by the cutter driving motor 168 for rotation. However, the cutting edge is not limited to the cutter, but may be a substantially disk-shaped grinding wheel driven by a cutting-edge driving motor (or the cutter driving motor 168) for rotation.

Still further, in the above embodiment, the projected step 152*a* is formed on the first mount stand 152, which supports the leg portion of the frame 161, in the side farther away from the second mount stand 153, and the surface of the projected step 152*a* facing toward the second mount stand 153 is defined as the vertical reference surface Fv3. However, the mounting structure is not limited to such an arrangement, but may be modified such that the projected step 152*a* is formed on the first mount stand 152 in the side nearer to the second mount stand 153, and the vertical reference surface Fv3 is formed to face away from the second mount stand 153.

It is to be understood that the present invention is not limited to the embodiments described above, but includes a variety of modifications involving any combinations of the illustrated embodiments.

What is claimed is:

1. A polishing apparatus comprising:

a plurality of polishing stations for polishing materials to be polished and a plurality of cleaning stations for cleaning the materials being polished, said polishing stations and said cleaning stations being alternately arranged, each of said cleaning stations comprising a retainer stand on which the material being polished is placed;

an arm mounted for holding the materials being polished and transferring the materials being polished between said polishing stations and said cleaning stations successively, said arm including a polishing head for holding the material being polished; and a cleaning device positioned for cleaning the material being held by said polishing head, cleaning the material being polished placed on said retainer stand, and cleaning said polishing head where the material being polished is separate from said polishing head.

2. A polishing apparatus according to claim 1, wherein said retainer stand is positioned in opposite relation to said polishing head provided on said arm and is movable in a direction toward said polishing head while keeping the opposite relation, wherein said cleaning device comprises a cleaning member;

further comprising a cleaning-member driving device for advancing said cleaning member to a position between said polishing head and said retainer stand.

3. A polishing apparatus according to claim 1, wherein said arm is mounted for rotation about a rotating shaft, and wherein said polishing stations and said cleaning stations are arranged substantially on a circle about said rotating shaft.

4. A polishing apparatus according to claim 1, wherein each of said polishing stations includes a platen having a polishing pad affixed to a surface of said platen, and wherein said arm includes a plurality of polishing heads, each of which holds the material being polished and is rotatable about an axis thereof while keeping one surface of the material being polished in contact with said polishing pad, said arm including a plurality of spindles coupled to upper portions of said polishing heads and supporting said polishing heads in a horizontally rotatable manner; and a plurality of spindle housings having cylindrical fitting portions into which said spindles are fitted, each of said spindles being provided with an adjusting mechanism for adjusting an axial position of said polishing head by changing a position of said polishing head relative to said arm.

5. A polishing apparatus according to claim 4, wherein said spindle comprises a spindle body including a coupling portion provided at a lower end of said spindle for coupling to said polishing head;

a bearing for supporting said spindle body rotatably while maintaining an axial position of said bearing relative to said spindle body unchanged; and a cylindrical bearing support supporting said bearing and having a male threaded portion formed on an outer periphery of said bearing support, and wherein a female threaded portion meshing with said male threaded portion is formed in an inner periphery of said fitting portion of said spindle housing, said polishing head being movable in the axial direction when said male threaded portion is rotated while meshing with said female threaded portion.

6. A polishing apparatus according to claim 4, further comprising a conditioner for conditioning a surface state of said polishing pad, wherein said conditioner includes a loading eliminating part for separating foreign matter which is deposited on said polishing pad, from said polishing pad;

a cover covering said loading eliminating part to form a space isolated from the outside between said cover and a surface of said polishing pad; and a sucking device connected to the space formed between said cover and the surface of said polishing pad for sucking the foreign matter on said polishing pad.

7. A polishing apparatus according to claim 6, wherein said conditioner has an arm for supporting and moving said loading eliminating part on said polishing pad, and wherein said loading eliminating part includes a dresser supported by said arm.

8. A polishing apparatus according to claim 7, wherein said conditioner includes a lifting part for moving said dresser up and down within said cover.

9. A polishing apparatus according to claim 6, wherein said loading eliminating part includes a cleaning-liquid jetting device positioned for spraying a cleaning liquid to said polishing pad.

10. A polishing apparatus according to claim 9, wherein said cleaning-liquid jetting device includes a ultrasonic wave generating device.

11. A polishing apparatus according to claim 4, further comprising a cleaning device for a conditioner comprising a substantially disk-shaped dresser having a dressing portion, a rotating/driving mechanism for rotating said dresser, and a moving mechanism for moving said dresser toward and away from said polishing pad, said conditioner cleaning device comprising a deposit scraper provided to be able to come into contact with said dresser for scraping off deposits on said dresser; and a cleaning liquid supply mechanism constructed to supply a cleaning liquid to a contact area between said deposit scraper and said dresser when said deposit scraper is in contact with said dresser.

12. A polishing apparatus according to claim 11, wherein said conditioner cleaning device includes a scraper driving mechanism for driving said deposit scraper to move in sliding contact with a surface of said dressing portion when said deposit scraper is in contact with said dresser.

13. A polishing apparatus according to claim 12, wherein said scraper driving mechanism comprises a shaft body for supporting said deposit scraper; and a driving device for driving said shaft body for rotation.

14. A polishing apparatus according to claim 13, wherein said deposit scraper is formed of members which allow the cleaning liquid to permeate into and to be held by said members, and wherein said cleaning liquid supply mechanism comprises a cleaning liquid reservoir; and wherein at least a part of said deposit scraper is immersed in the cleaning liquid when the cleaning liquid is reserved in said cleaning liquid reservoir.

15. A polishing apparatus according to claim 13, wherein said shaft body has a hollow portion formed therein and a plurality of holes extending from said hollow portion to open at an outer peripheral surface of said shaft body for communication with the outside, wherein said deposit scraper is formed of members which allow the cleaning liquid to permeate into and to be held by said members, and wherein said cleaning liquid supply mechanism includes a cleaning liquid supply device for supplying the cleaning liquid to a surface of said deposit scraper from said hollow portion through said plurality of holes.

16. A polishing apparatus according to claim 11, further comprising cleaning-liquid reclaiming device.

17. A polishing apparatus according to claim 4, further comprising a cleaning device for a conditioner comprising a substantially disk-shaped dresser having a dressing portion, a rotating/driving mechanism for rotating said dresser, and a moving mechanism for moving said dresser toward and away from said polishing pad, said conditioner cleaning device comprising a high-pressure cleaning liquid supply mechanism for spraying the cleaning liquid under high pressure toward said dresser.

18. A polishing apparatus according to claim 4, further comprising a cleaning device for a conditioner comprising a substantially disk-shaped dresser having a dressing portion, a rotating/driving mechanism for rotating said dresser, and a moving mechanism for moving said dresser toward and away from said polishing pad, said conditioner cleaning device comprising an ultrasonic wave applying mechanism for applying ultrasonic oscillations to the cleaning liquid.

19. A polishing apparatus according to claim 4, further comprising a grooving device having a cutting edge engagable on said polishing pad.

20. A polishing apparatus according to claim 12, wherein said grooving device includes a cutting-edge moving device for moving said cutting edge on said platen to follow a straight line passing the center of rotation of said platen.

21. A polishing apparatus according to claim 19, wherein said grooving device is detachably mounted to a polishing apparatus body.

22. A polishing apparatus according to claim 19, wherein said polishing pad has a thickness T of not less than 5 mm.

* * * * *

UNITED STATES PATENT AND TRADEMARK OFFICE

CERTIFICATE OF CORRECTION

PATENT NO. : 6,488,573 B1
DATED : December 3, 2002
INVENTOR(S) : Kobayashi et al.

It is certified that error appears in the above-identified patent and that said Letters Patent is hereby corrected as shown below:

Title page,
Item [30], Foreign Application Priority Data should read:

-- [30] Foreign Application Priority Data

Aug. 30, 1999 (JP) ..... 11-244120
Jan. 12, 2000 (JP) ..... 2000-004058
Mar. 10, 2000 (JP) ..... 2000-067799
Mar. 30, 2000 (JP) ..... 2000-093834
Mar. 31, 2000 (JP) ..... 2000-099648 --

Signed and Sealed this

Twenty-seventh Day of May, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,488,573 B1
DATED : December 3, 2002
INVENTOR(S) : Kobayashi et al.

It is certified that error appears in the above-identified patent and that said Letters Patent is hereby corrected as shown below:

Title page,
Item [30], Foreign Application Priority Data should read:

-- [30] Foreign Application Priority Data

Aug. 30, 1999 (JP) ..... 11-244120
Jan. 14, 2000 (JP) ..... 2000-004058
Mar. 10, 2000 (JP) ..... 2000-067799
Mar. 30, 2000 (JP) ..... 2000-093834
Mar. 31, 2000 (JP) ..... 2000-099648 --

This certificate supersedes Certificate of Correction issued May 27, 2003.

Signed and Sealed this

Twenty-ninth Day of June, 2004

JON W. DUDAS
*Acting Director of the United States Patent and Trademark Office*